US008425000B2

(12) United States Patent
Chikamoto

(10) Patent No.: US 8,425,000 B2
(45) Date of Patent: Apr. 23, 2013

(54) IMAGE RECORDING APPARATUS

(75) Inventor: Tadanobu Chikamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 394 days.

(21) Appl. No.: 12/180,750

(22) Filed: Jul. 28, 2008

(65) Prior Publication Data

US 2009/0027445 A1 Jan. 29, 2009

(30) Foreign Application Priority Data

Jul. 26, 2007 (JP) ..... 2007-194037
Jul. 26, 2007 (JP) ..... 2007-194040
Sep. 6, 2007 (JP) ..... 2007-231289

(51) Int. Cl.
*B41J 2/165* (2006.01)

(52) U.S. Cl.
USPC ..... 347/29

(58) Field of Classification Search ..... 347/29
See application file for complete search history.

(56) References Cited

U.S. PATENT DOCUMENTS 5,428,380 A * 6/1995 Ebisawa ..... 347/35
2002/0044168 A1 4/2002 Hashi et al.
2003/0081055 A1 5/2003 Wotton et al.
2004/0125189 A1 7/2004 Kuki et al.
2005/0036022 A1 2/2005 Okamoto et al.
2005/0046667 A1* 3/2005 Ando et al. ..... 347/40
2005/0057602 A1 3/2005 Okamoto
2005/0093939 A1 5/2005 Takagi
2005/0151812 A1* 7/2005 Sasaki et al. ..... 347/86
2005/0168518 A1 8/2005 Nishino
2006/0066670 A1 3/2006 Kang
2006/0203030 A1 9/2006 Tobita et al.
2006/0203032 A1 9/2006 Takagi
2006/0209120 A1 9/2006 Takagi
2006/0274108 A1 12/2006 Shimizu (Continued)

FOREIGN PATENT DOCUMENTS

CN 1496839 A 5/2004
CN 1751884 A 3/2006

(Continued)

OTHER PUBLICATIONS

European Patent Office, European Search Report for Related EP Application No. 08013487 dated Nov. 26, 2008.

(Continued)

*Primary Examiner* — Uyen Chau N Le
*Assistant Examiner* — Hoang Tran
(74) *Attorney, Agent, or Firm* — Baker Botts L.L.P.

(57) ABSTRACT

An image recording apparatus includes heads arranged so that their ejection faces make a first row and a second row each extending in a first direction, caps to cover respective ejection faces of the heads, and a moving mechanism to move the caps. When the caps are at their withdrawal positions, the caps corresponding to the respective heads constituting the first row are disposed so as to overlap the heads of the first row with respect to a second direction parallel to the ejection faces, and overlap the heads of the second row with respect to the first direction, and the caps corresponding to the respective heads constituting the second row are disposed so as to overlap the heads of the second row with respect to the second direction, and overlap the heads of the first row with respect to the first direction.

34 Claims, 12 Drawing Sheets

U.S. PATENT DOCUMENTS

| | | | |
|---|---|---|---|
| 2007/0126817 | A1 | 6/2007 | Takagi |
| 2009/0027446 | A1 | 1/2009 | Taira |
| 2009/0027447 | A1 | 1/2009 | Chikamoto et al. |

FOREIGN PATENT DOCUMENTS

| | | | |
|---|---|---|---|
| JP | 2003-001855 | A | 1/2003 |
| JP | 2004-066468 | A | 3/2004 |
| JP | 2005-053119 | A | 3/2005 |
| JP | 2005-067194 | A | 3/2005 |
| JP | 2005-132025 | A | 5/2005 |
| JP | 2005-212319 | A | 8/2005 |
| JP | 2006-240192 | A | 9/2006 |
| JP | 2006-247844 | A | 9/2006 |
| JP | 2009-028974 | A | 2/2009 |
| JP | 2009-028975 | A | 2/2009 |
| WO | 2007061138 | A1 | 5/2007 |

OTHER PUBLICATIONS

The State Intellectual Property Office of the People's Republic of China; Notification of First Office Action in Chinese Patent Application No. 200810131109.3 mailed Jan. 8, 2010.

Japan Patent Office, Notice of Reasons for Rejection for Japanese Patent Application No. 2007-194037, mailed Oct. 18, 2011.

Japan Patent Office, Notice of Reasons for Rejection for Japanese Patent Application No. 2011-276879, mailed Mar. 27, 2012.

* cited by examiner

IMAGE RECORDING APPARATUS

CROSS REFERENCE TO RELATED APPLICATION

The present application claims priority from Japanese Patent Applications No. 2007-194037, No. 2007-194040 and No. 2007-231289, each of which is filed on Jul. 26, 2007, the disclosure of which is herein incorporated by reference in its entirety.

BACKGROUND OF THE INVENTION

1. Field of the Invention

The present invention relates to an image recording apparatus having a plurality of heads for ejecting liquids.

2. Description of Related Art

Japanese Patent Unexamined Publication No. 2005-132025 discloses an inkjet printer including four long inkjet heads arranged along a paper conveyance path, and a maintenance unit for maintenance of the four heads. The maintenance unit includes a base that is horizontally movable in parallel with the paper conveyance path; a blade, a wiping roller, and an ink suction member provided on the base; and four caps. The caps are long-shaped and arranged in parallel along the paper conveyance path so as to be able to cover ejection faces of the respective heads.

In the above publication, when the maintenance unit is at a position opposed to the heads, a so-called purge operation is performed in which the caps cover the ejection faces of the respective heads, and in this state, nozzles of the heads eject ink toward the caps. After the purge operation, the caps are separated from the ejection faces of the respective heads. The maintenance unit then moves toward a withdrawal position. During the movement of the maintenance unit, the ink suction member or an ink receiving member, the wiping roller, and the blade are sequentially opposed to the ejection faces of the heads so that ink is sucked and wiped by the respective members. Maintenance of the heads is thus performed.

SUMMARY OF THE INVENTION

In the above-described printer, the withdrawal position of the maintenance unit is on the downstream side of the heads with respect to the paper conveyance direction. This causes an increase in the size of the printer with respect to the conveyance direction.

An object of the present invention is to provide an image recording apparatus capable of reducing its size even though the apparatus has a plurality of heads.

According to the present invention, an image recording apparatus comprises a plurality of heads each of which has an ejection face. The heads are arranged so that their ejection faces make a first row and a second row each of which extends in a first direction, and ejection faces belonging to the different rows do not overlap each other with respect to a second direction parallel to the ejection faces and perpendicular to the first direction. The apparatus further comprises a conveyance mechanism that conveys a recording medium in the first direction in a state that the recording medium is facing the ejection faces; a plurality of caps that come into contact with the respective ejection faces to cover the ejection faces; and a moving mechanism that moves the caps between capping positions where the caps are opposed to the respective ejection faces with respect to a third direction perpendicular to the ejection faces, and withdrawal positions where the caps are not opposed to the respective ejection faces with respect to the third direction. When the caps are at their withdrawal positions, the caps corresponding to the respective heads constituting the first row are disposed so as to overlap the heads of the first row with respect to the second direction, and overlap the heads of the second row with respect to the first direction, and the caps corresponding to the respective heads constituting the second row are disposed so as to overlap the heads of the second row with respect to the second direction, and overlap the heads of the first row with respect to the first direction.

According to the invention, the heads are arranged so that their ejection faces make two rows each extending in the first direction, and ejection faces belonging to the different rows do not overlap each other with respect to the second direction. Thus, an empty space is provided in a region neighboring each group of heads with respect to the second direction. The caps corresponding to the heads of each group are disposed within the space. Therefore, there is no necessity of providing any special space for providing the caps. This realizes a reduction in the size of the apparatus.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Hereinafter, preferred embodiments of the present invention will be described with reference to the accompanying drawings.

Figure 1:
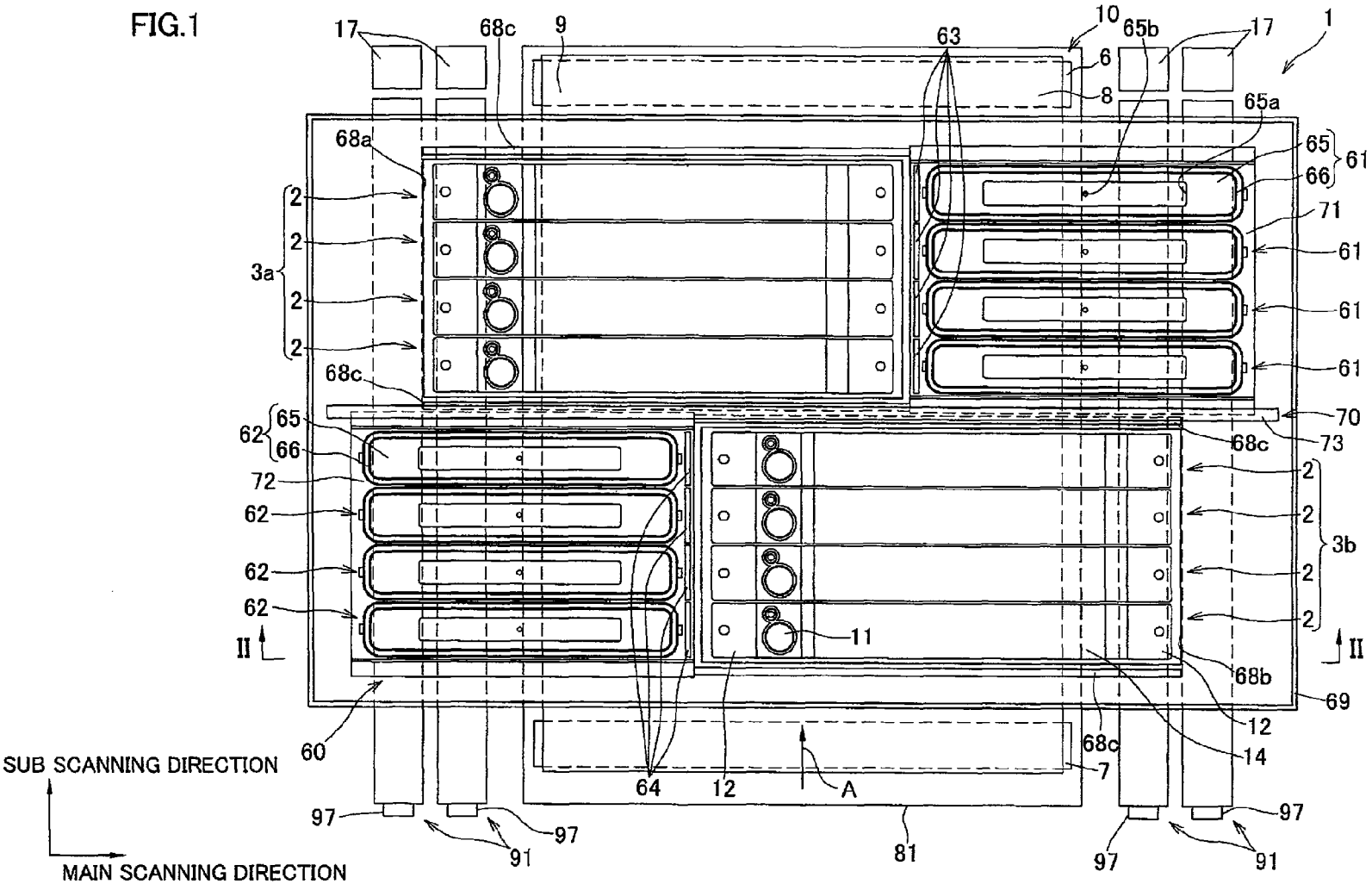
FIG. 1 is a plan view of a principal part of an inkjet printer according to a first embodiment of the present invention.
Figure 2:
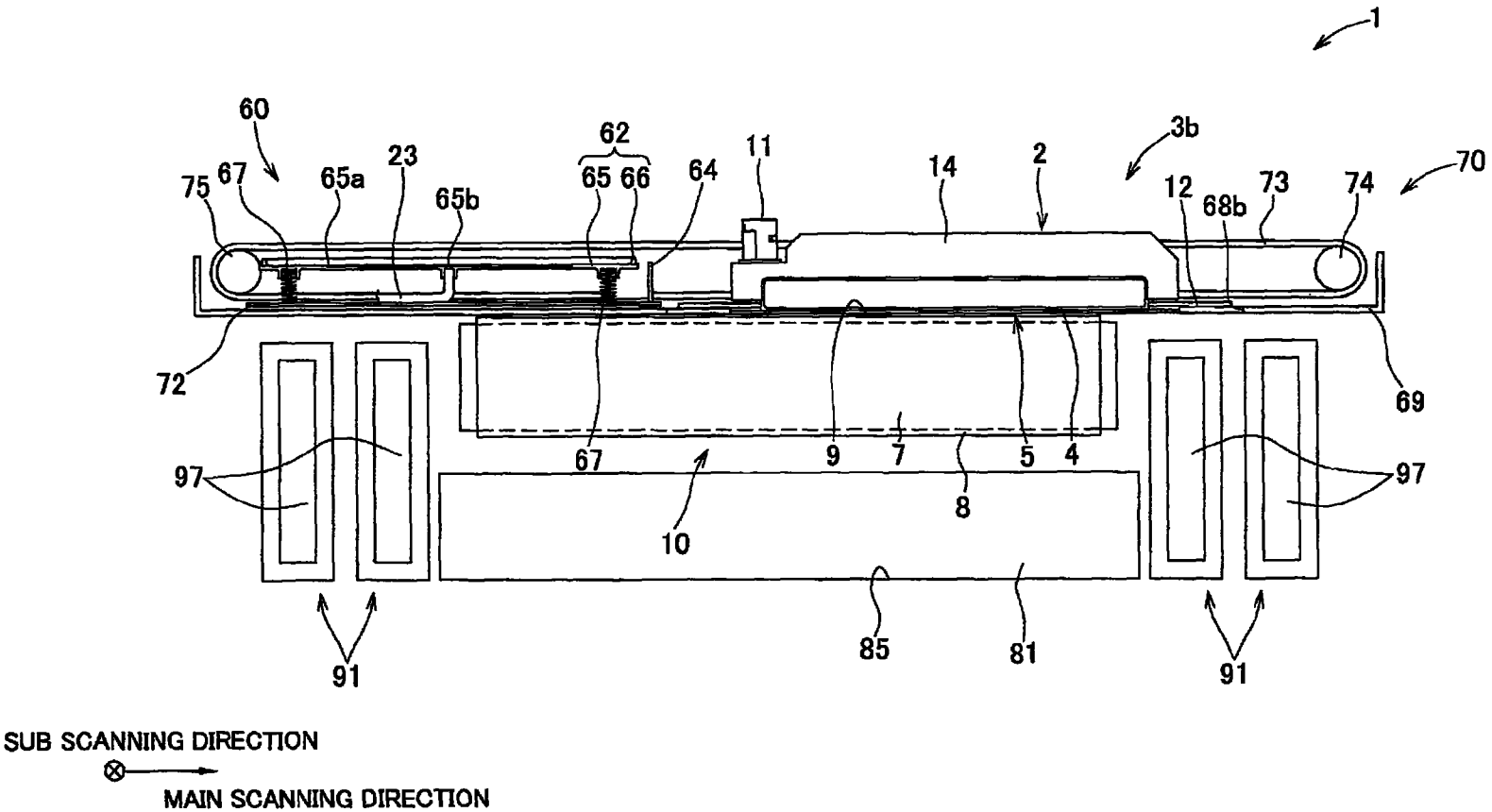
FIG. 2 is a partial sectional view taken along line II-II in FIG. 1.

An inkjet printer 1 according to a first embodiment of the present invention is a line type color inkjet printer. As shown in FIG. 1, the printer 1 includes two head groups 3*a* and 3*b* each of which is constituted by four inkjet heads 2. As shown in FIGS. 1 and 2, the printer 1 further includes a paper feed cassette 81 and a not-shown paper discharge section, which are provided under and over the head groups 3*a* and 3*b*, respectively. The printer 1 further includes a paper conveyance mechanism 10 that sequentially conveys papers as recoding media fed from the paper feed cassette 81, in a conveyance direction A to a position immediately below each head 2.

A paper fed out from the paper feed cassette 81 is sent to the lower end of the conveyance mechanism 10 in FIG. 1 with being guided by a not-shown guide that interconnects the paper feed cassette 81 and the conveyance mechanism 10. The paper is then conveyed in the conveyance direction A by the conveyance mechanism 10. During the conveyance, printing on the paper is performed by each head 2. Afterward, the paper is sent to the paper discharge section with being guided by a not-shown guide that interconnects the conveyance mechanism 10 and the paper discharge section.

The paper feed cassette 81 has a hollow box shape, which receives therein a stack of papers. The paper feed cassette 81 is attachable to the printer 1 in a sub scanning direction and detachable from the printer 1 in the reverse direction. When all papers in the paper feed cassette 81 were used up, the paper feed cassette 81 is drawn out in a direction the reverse of the direction A. The paper feed cassette 81 replenished with new papers is attached to the printer 1 in the direction A.

As shown in FIG. 1, the conveyance mechanism 10 includes a pair of rollers 6 and 7 disposed on both sides of the two head groups 3*a* and 3*b* with respect to the sub scanning direction; and an endless conveyor belt 8 wrapped on and stretched between the rollers 6 and 7. The conveyor belt 8 is disposed so that the upper side surface of the belt is parallel to and vertically opposed to the ejection face 4 of each head 2. The roller 7 is driven by a not-shown conveyance motor to rotate in a predetermined direction. By the rotation of the roller 7, the conveyor belt 8 runs to convey a paper in the conveyance direction A, which corresponds to the sub scanning direction.

The conveyor belt 8 has a two-layered structure made of a base material and urethane rubber. The outer circumferential surface of the conveyor belt 8, that is, a conveyance surface 9, has adhesiveness. A paper fed out from the paper feed cassette 81 is conveyed in the conveyance direction A with being held on the conveyor belt 8 by the adhesiveness of the conveyance surface 9.

As shown in FIGS. 1 and 2, each of the eight heads 2 has a rectangular parallelepiped shape extending in a main scanning direction perpendicular to the sub scanning direction. Each head 2 has at its lower end a head main body 5 the lower face of which is formed into an ejection face 4.

On the upper face of each head main body 5, there is fixed a reservoir unit that is partially covered with a cover 14. A tube joint 11 is connected to the left end of each reservoir unit in FIG. 1. In each reservoir unit formed is a reservoir that temporarily stores therein ink supplied through the corresponding tube joint 11. Each tube joint 11 is connected to a corresponding ink cartridge 91 through a tube or the like. Ink stored in the reservoir of each reservoir unit is appropriately fed into passages in the corresponding head main body 5.

Each reservoir unit is longer than the corresponding head main body 5 with respect to the main scanning direction so that protrusions 12 are formed at both ends of the reservoir unit with respect to the main scanning direction. All heads 2 are fixed to a not-shown elevator frame through the protrusions 12 of the respectively corresponding reservoir units so that the heads 2 can vertically move when the elevator frame is moved up or down by a not-shown elevating mechanism.

Figure 3:
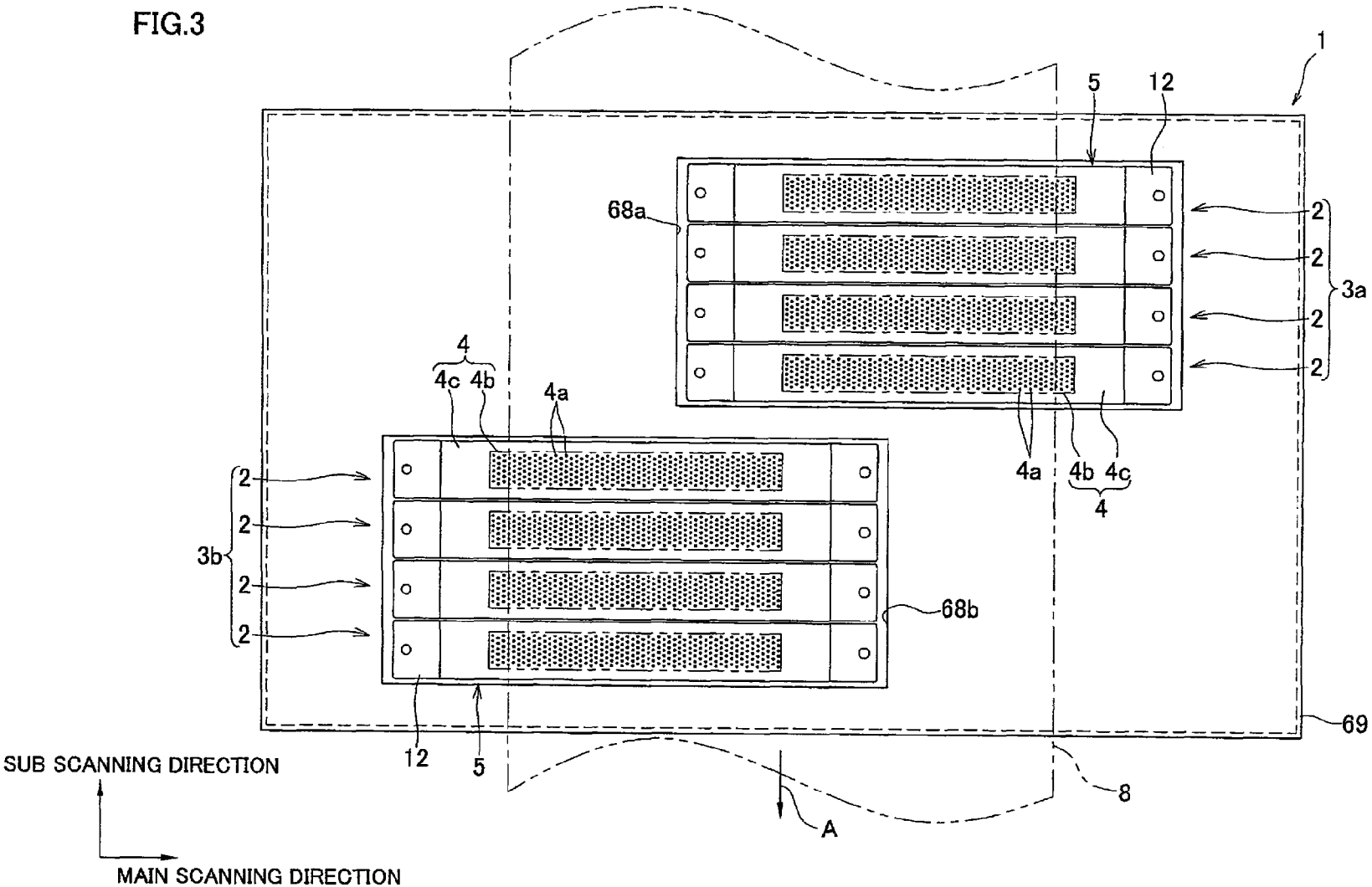
FIG. 3 is a lower view of two head groups included in the printer.

At the time of printing, each head 2 is at a printing position as shown in FIGS. 1, 2, and 3, where the ejection face 4 of the head 2 is parallel to the conveyance surface 9 of the upper part of the conveyor belt 8, and a predetermined gap is formed between the ejection face 4 and the conveyance surface 9. While a paper being held on the conveyor belt 8 sequentially passes immediately below the ejection faces 4 of the heads 2 that are at their printing positions, inks are ejected from the respective ejection faces 4 to form a desired image on the paper.

Figure 5A:
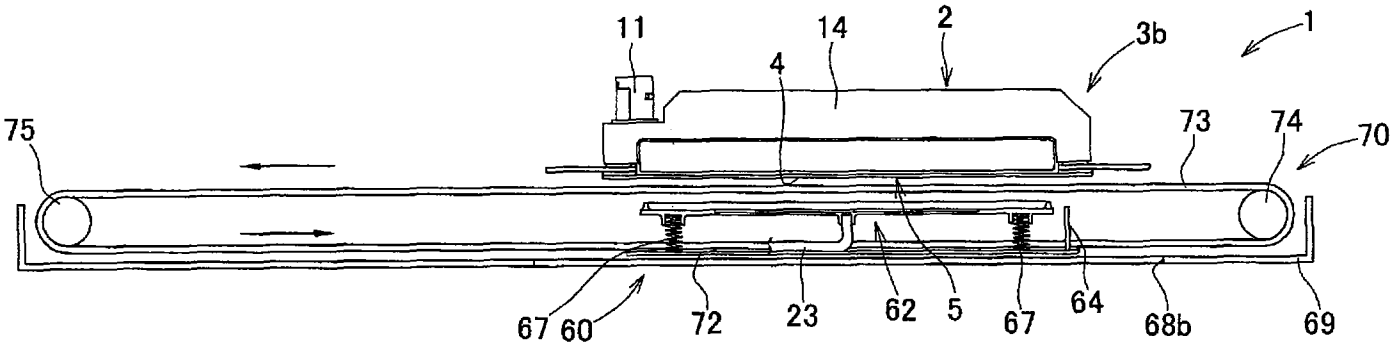
FIGS. 5A, 5B, and 5C time-sequentially show a purge operation for a head and a wiping operation for the ejection face of the head.

At the time of maintenance of the heads 2, the elevator frame is driven by the not-shown elevating mechanism to move up. Thereby, each head 2 is moved to a maintenance position, as shown in FIG. 5A, upper than the printing position.

As shown in FIG. 3, the ejection face 4 of each head 2 has an ejection region 4*b* where a large number of very small-diameter nozzles 4*a* are formed for ejecting ink; and an outside region 4*c* surrounding the ejection region 4*b*.

As shown in FIG. 3, the eight heads 2 are divided into two head groups 3*a* and 3*b* each of which is constituted by four heads 2. In the four heads 2 belonging to each of the head groups 3*a* and 3*b*, the ejection regions 4*b* of the ejection faces 4 are disposed at the same position with respect to the main scanning direction while neighboring each other with respect to the sub scanning direction.

Assuming that the ejection regions 4*b* of the four heads 2 belonging to each of the head groups 3*a* and 3*b* make one unit, the head groups 3*a* and 3*b* are disposed so that the units make two rows each extending in the sub scanning direction, and do not overlap each other with respect to the main scanning direction. End portions of the ejection faces 4 of the heads 2 belonging to the respective head groups 3*a* and 3*b* partially overlap each other with respect to the main scanning direction. The head groups 3*a* and 3*b* are arranged zigzag with respect to both the sub and main scanning directions.

The heads 2 are disposed with respect to the main scanning direction so that each interval between the innermost nozzles 4*a* of each ejection region 4*b* of the head group 3*a* with respect to the main scanning direction, that is, the leftmost nozzles 4*a* in FIG. 3, and the innermost nozzles 4*a* of each ejection region 4*b* of the head group 3*b* with respect to the main scanning direction, that is, the rightmost nozzles 4*a* in FIG. 3, is equal to each interval between the nozzles 4*a* of each ejection region 4*b*. The interval corresponds to printing resolution. The above relation applies to any head 2 belonging to the head groups 3*a* and 3*b*. In the four heads 2 belonging to each of the head groups 3*a* and 3*b*, the nozzles 4*a* are arranged with respect to the sub scanning direction so that an imaginary straight line passing through one nozzle 4*a* of one head 2 passes through one nozzle 4*a* of each of the remaining three heads 2. The four nozzles 4*a* on the imaginary straight line are arranged at the same intervals as the four heads 2.

The four heads 2 belonging to each of the head groups 3*a* and 3*b* eject inks of four different colors of magenta, yellow, cyan, and black. That is, each of the head groups 3*a* and 3*b* includes one head 2 for ejecting the same color ink. The heads 2 belonging to the respective head groups 3*a* and 3*b* for ejecting the same color ink form a long printing region for the color.

Of the four heads 2 belonging to the head group 3*a*, a head 2 the nearest to the head group 3*b*, that is, the lowermost head 2 in FIG. 3, ejects black ink, which is the lowest in brightness. A head 2 the farthest from the head group 3*b*, that is, the uppermost head 2 in FIG. 3, ejects yellow ink, which is the highest in brightness. The remaining two heads 2 sandwiched by the above two heads 2 eject magenta and cyan inks, respectively.

Of the four heads 2 belonging to the head group 3*b*, a head 2 the nearest to the head group 3*a*, that is, the uppermost head 2 in FIG. 3, ejects black ink, which is the lowest in brightness.

A head 2 the farthest from the head group 3*a*, that is, the lowermost head 2 in FIG. 3, ejects yellow ink, which is the highest in brightness. The remaining two heads 2 sandwiched by the above two heads 2 eject magenta and cyan inks, respectively.

As shown in FIGS. 1 and 2, four ink cartridges 91 storing therein inks of four different colors of magenta, yellow, cyan, and black are attached to the printer 1. Each cartridge 91 is attachable and detachable in the same directions as the paper feed cassette 81, that is, in the sub scanning direction and the reverse direction.

The cartridges 91 are disposed under caps 61 and 62 disposed at a withdrawal position, which will be described later. In addition, the cartridges 91 are disposed in two pairs so as to sandwich the conveyance mechanism 10 and the paper feed cassette 81 with respect to the main scanning direction. More specifically, the cartridges 91 are disposed at a vertically lower level than the ejection faces 4 of the heads 2 so as not to vertically overlap the conveyance mechanism 10 and so as to vertically overlap the caps 61 and 62 disposed at the withdrawal position. The inner two cartridges 91 other than the outer two cartridges 91 with respect to the main scanning direction vertically overlap the heads 2.

Figure 4:
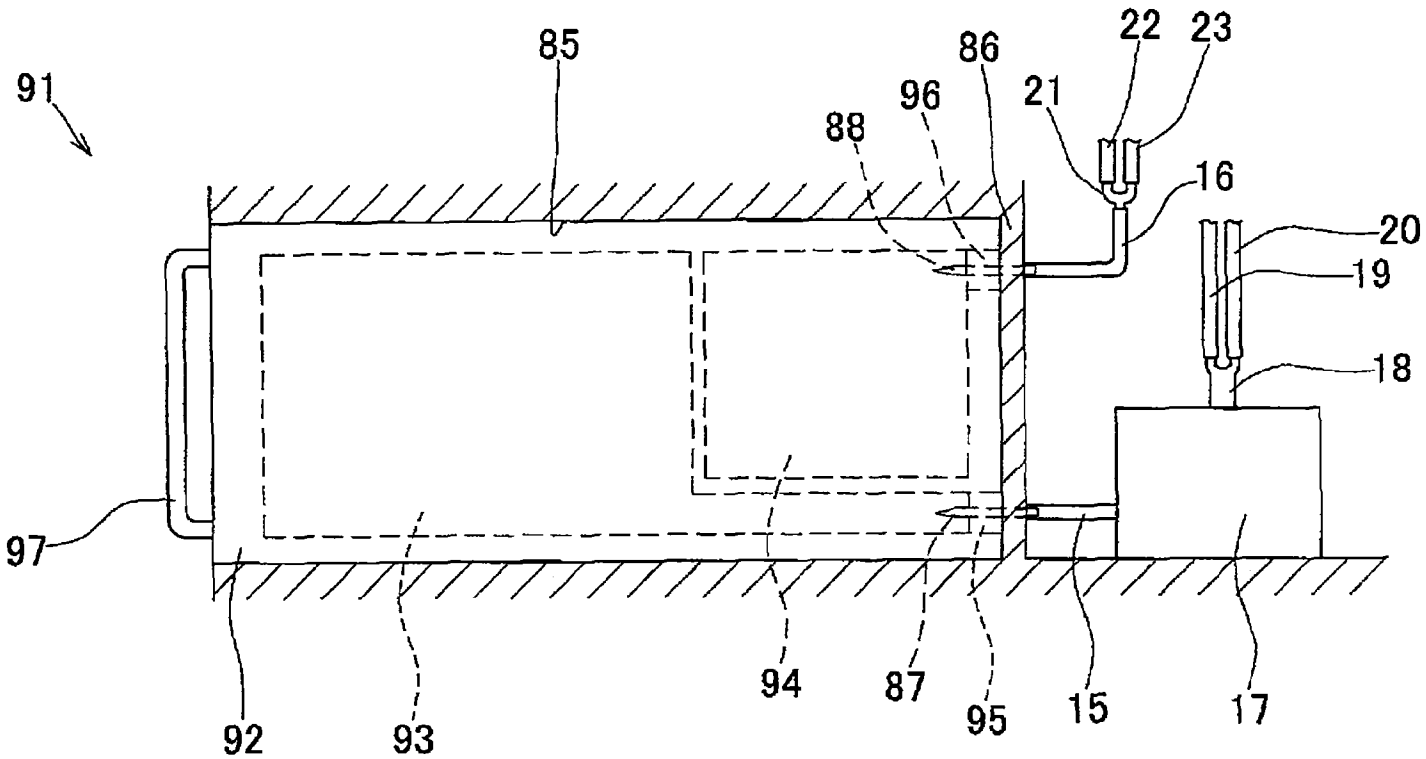
FIG. 4 is a partial sectional view of an ink cartridge attached to the printer, and the periphery of the cartridge.

As shown in FIGS. 1 and 4, each cartridge 91 has a rectangular parallelepiped shape extending in the sub scanning direction. Each cartridge 91 includes a case 92; and an ink reservoir 93 and a waste ink reservoir 94 provided in the case 92. The ink reservoir 93 stores therein ink to be fed to the corresponding head 2. The waste ink reservoir 94 stores therein waste ink discharged from the head 2 by a purge operation. To the case 92 fixed are a rubber plug 95 to stop an ink outlet of the ink reservoir 92, and a rubber plug 96 to stop an inlet of the waste ink reservoir 94. A handle 97 is provided on the left side face of the case 92 in FIG. 4. The handle 97 makes the cartridge 91 easy to be attached to and detached from a corresponding cartridge attachment portion 85 of the printer 1.

The cartridge attachment portion 85 has a recessed shape open in the opposite direction from the conveyance direction A. Two hollow needles 87 and 88 are fixed to a bottom wall 86 of the cartridge attachment portion 85, that is, the right wall of the cartridge attachment portion 85 in FIG. 4, so as to correspond to the respective rubber plugs 95 and 96. When the cartridge 91 is completely inserted in the cartridge attachment portion 85, the hollow needles 87 and 88 penetrate the rubber plugs 95 and 96, respectively. The ends of the hollow needles 87 and 88 facing the rubber plugs 95 and 96 are tapered. Flexible tubes 15 and 16 are connected to the opposite ends of the hollow needles 87 and 88 from their tapered ends, respectively.

The tube 15 connects the hollow needle 87 to a pump 17. When the cartridge 91 has been attached in the cartridge attachment portion 85, the pump 17 is driven in a purge operation or the like to forcibly feed ink from the corresponding ink reservoir 93 into the corresponding heads 2. The pump 17 is not driven in any printing operation, and ink in the reservoir 93 flows to the heads 2 through an ink passage formed in the pump 17.

A Y-shaped pipe 18 is provided on the upper end of the pump 17 to branch ink from the pump 17 into two ways. Flexible tubes 19 and 20 are connected to the Y-shaped pipe 18. The tubes 19 and 20 are connected to the tube joints 11 of two heads 2 belonging to the different head groups 3*a* and 3*b*, respectively. Thus, ink is fed from one cartridge 91 to two heads 2 belonging to the different head groups 3*a* and 3*b* through the pump 17 and the tubes 19 and 20.

A Y-shaped pipe 21 is connected to the opposite end of the tube 16 from the hollow needle 88. Flexible tubes 22 and 23 are connected to the Y-shaped pipe 21. The tubes 22 and 23 are connected to the caps 61 and 62 corresponding to two heads 2 belonging to the different head groups 3*a* and 3*b*. Thus, waste ink discharged into the caps 61 and 62 flows into the waste ink reservoir 94 through the tubes 22 and 23.

Next will be described a maintenance unit 60 for performing a maintenance operation for heads 2. The maintenance unit 60 includes caps 61 and wipers 63 corresponding to the respective heads 2 belonging to each of the head groups 3*a* and 3*b*; a moving mechanism 70 for moving the caps 61 and the wipers 63 and caps 62 and wipers 64 in the opposite directions from each other with respect to the main scanning direction; and a tray 69 carrying thereon the caps 61 and 62, the wipers 63 and 64, and the moving mechanism 70.

Rectangular through holes 68*a* and 68*b* are formed in the tray 69 so as to be opposed to the respective head groups 3*a* and 3*b*. Each of the through holes 68*a* and 68*b* has its size that can include all of the ejection faces 4 of the four heads 2 belonging to the corresponding one of the head groups 3*a* and 3*b*.

The caps 61 and 62 have the same shape and the same size. Each of the caps 61 and 62 includes a base 65 having its shape substantially similar to that of the ejection region 4*b* of the ejection face 4 of the corresponding head 2 and somewhat larger than the ejection region 4*b*; and an annular protrusion 66 standing at the periphery of the base 65. Each of the caps 61 and 62 covers the ejection region 4*b* of the ejection face 4 of the corresponding head 2 in a state that the upper end of its annular protrusion 66 is in contact with an outside region 4*c* of the ejection face 4. Thus, ink in the nozzles 4*a* of the head 2 is prevented from drying.

As shown in FIG. 2, each of the caps 61 and 62 is supported from below by two springs 67. The springs 67 absorb the shock when the annular protrusion 66 comes into contact with the ejection face 4. This prevents the ejection face 4 from being damaged.

The base 65 has a recess 65*a* open vertically upward. At the center of the bottom of the recess 65*a*, a through hole 65*b* is formed that is connected to a tube 22 or 23. Ink ejected from nozzles 4*a* in a purge operation and stored in the recess 65*a* of the cap 61 or 62 is discharged into the corresponding waste ink reservoir 94 through the through hole 65*b* and the tube 22 or 23.

At the time of printing, as shown in FIG. 1, the wipers 63 or 64 are disposed, in a plan view, in between the caps 61 or 62 and the corresponding heads 2. When the caps 61 and 62 have not been lowered by a cap level control mechanism, which will be described later, the upper ends of the wipers 63 and 64 are at substantially the same level as the bases 65 of the caps 61 and 62. Each of the wipers 63 and 64 is made of an elastic material such as rubber or a resin.

To one head 2, a cap and a wiper are arranged adjacent to each other in a row in the main scanning direction. With respect to the sub scanning direction, the cap and the wiper are disposed at the same position as the head 2. The four wipers 63 or 64 corresponding to each of the head groups 3*a* and 3*b* are arranged in a row distantly from each other with respect to the sub scanning direction. The whole width of each of the wipers 63 and 64 is substantially equal to the whole width of the ejection face 4 of each head 2. Thus, even when the four heads 2 belonging to each of the head groups 3*a* and 3*b* eject inks of different colors, the inks are prevented from being mixed in color by wiping.

As shown in FIGS. 1 and 2, the moving mechanism 70 includes two horizontally extending supporting plates 71 and 72; an endless belt 73 sandwiched by the supporting plates 71 and 72 with respect to the sub scanning direction; and a pair of rollers 74 and 75 disposed outside the head groups 3*a* and 3*b* with respect to the main scanning direction.

The supporting plate 71 carries thereon the caps 61 and the wipers 63 corresponding to the respective heads 2 belonging to the head group 3*a*. The caps 61 and the wipers 63 are adjacent to each other with respect to the main scanning direction, and disposed at the same position as the corresponding heads 2 of the head group 3*b*. The supporting plate 72 carries thereon the caps 62 and the wipers 64 corresponding to the respective heads 2 belonging to the head group 3*b*. The caps 62 and the wipers 64 are adjacent to each other with respect to the main scanning direction, and disposed at the same position as the corresponding heads 2 of the head group 3*a*.

The belt 73 is wrapped on and stretched between the rollers 74 and 75. The rollers 74 and 75 are rotatably supported by the tray 69 so that the belt 73 is disposed in between the head groups 3*a* and 3*b* to extend in the main scanning direction, and the upper and lower parts of the belt 73 are vertically opposed to each other. Thus, even when the belt 73 is disposed between the head groups 3*a* and 3*b*, the distance between the head groups 3*a* and 3*b* can be reduced. In addition, the length of the belt 73 can be relatively shortened. This improves the accuracy of the conveyance of the caps 61 and 62.

The inner end of each of the supporting plates 71 and 72 with respect to the sub scanning direction is partially connected to the belt 73. More specifically, the supporting plate 71 is connected to the upper part of the belt 73 while the supporting plate 72 is connected to the lower part of the belt 73. Thus, when the belt 73 runs, the supporting plates 71 and 72 are moved in directions opposite to each other with respect to the main scanning direction.

As shown in FIG. 1, four guide rails 68*c* each extending in the main scanning direction are provided on the tray 69 so as to sandwich through holes 68*a* and 68*b* with respect to the sub scanning direction. The upper two guide rails 68*c* in FIG. 1 are slidably fitted in recesses formed at both ends of the supporting plate 71 with respect to the sub scanning direction. The same relation applies to the remaining two guide rails 68*c* and the supporting plate 72.

When a not-shown drive motor drives the roller 74 to rotate counterclockwise in FIG. 2, the two supporting plates 71 and 72 are moved to get near to each other. The supporting plates 71 and 72 are thereby moved from their withdrawal positions, as shown in FIG. 1, where no cap and no wiper are opposed to the ejection face 4 of the corresponding head 2, to their capping positions where each cap is opposed to the ejection face 4 of the corresponding head 2. When the roller 74 is rotated clockwise in FIG. 2, the two supporting plates 71 and 72 are moved to get away from each other. The supporting plates 71 and 72 are thereby moved from their capping positions to their withdrawal positions.

Next, operations of the maintenance unit 60 at the time of maintenance will be described with reference to FIGS. 5A, 5B, and 5C, and FIGS. 6A, 6B, and 6C. The maintenance includes a purge operation that is performed when a cartridge 91 is attached to the printer 1 or when ink ejection becomes bad; a wiping operation of wiping the ejection faces 4 of the heads 2 by the wipers 63 and 64 after the purge operation; and a capping operation of covering the ejection faces 4 of the heads 2 with the caps in a sleeping mode in which the printer 1 does not perform printing or the like for a long time period.

A purge operation and a wiping operation will be described with reference to FIGS. 5A to 5C. Before starting the purge operation, all heads 2 are moved up in advance from their printing positions to their maintenance positions, as shown in FIG. 5A. The roller 74 is then rotated counterclockwise in FIG. 5A to makes the belt 73 run. By the running of the belt 73, the supporting plates 71 and 72 corresponding to the respective head groups 3*a* and 3*b* are moved leftward and rightward in FIG. 1, respectively. Thereby, the supporting plates 71 and 72 are moved from their withdrawal positions to their capping positions.

When the supporting plates 71 and 72 are at their capping positions and the heads 2 are at their maintenance positions, the pumps 17 are driven so that inks in the ink reservoirs 94 of the cartridges 91 are forcibly fed into the respective heads 2. Thus, a purge operation is performed in which inks are ejected from the nozzles 4*a* of the heads 2 toward the caps 61 and 62. At this time, although the caps 61 and 62 are not in contact with the ejection faces 4 of the respectively corresponding heads 2, the ejected inks scarcely scatter around the caps 61 and 62 because the distances between the caps 61 and 62 and the ejection faces 4 are relatively small. Inks received in the caps 61 and 62 are discharged into the waste ink reservoirs 94 of the respective cartridges 91 through the tubes 22 and 23.

Figure 5B:
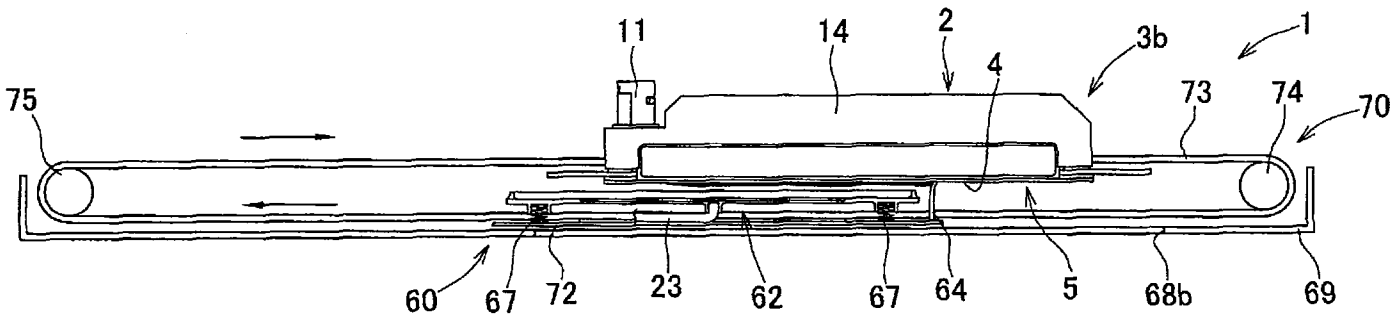

After the purge operation, as shown in FIG. 5B, all caps 61 and 62 are moved down by a not-shown cap level control mechanism so that the upper ends of the caps 61 and 62 are put at a lower level than the upper ends of the wipers 63 and 64. Afterward, all heads 2 are moved down to a level at which the ejection faces 4 of the heads 2 can come into contact with the upper ends of the wipers 63 and 64 with being distant from the upper ends of the caps 61 and 62. In this state, the roller 74 is rotated clockwise in FIG. 5B to move back the supporting plates 71 and 72 from their capping positions to their withdrawal positions. During the movements of the supporting plates 71 and 72, the wipers 63 and 64 come into contact, with bending, with the ejection faces 4 of the corresponding heads 2 to wipe off inks having adhered to the respective ejection faces 4 in the purge operation.

Figure 5C:
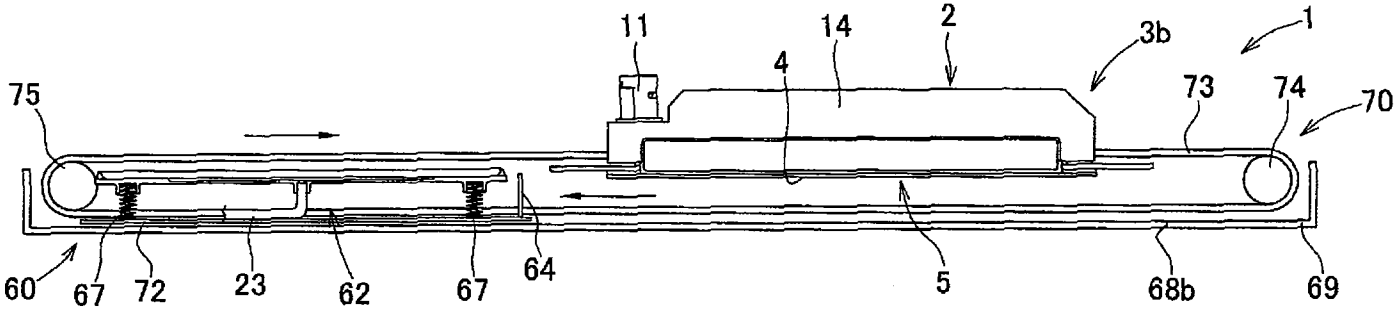

After the supporting plates 71 and 72 return to their withdrawal positions, as shown in FIG. 5C, the caps 61 and 62 are moved up to their original level by the cap level control mechanism. A sequence of operations including the purge operation and the wiping operation are thus completed.

Figures 6A, 6B, 6C:
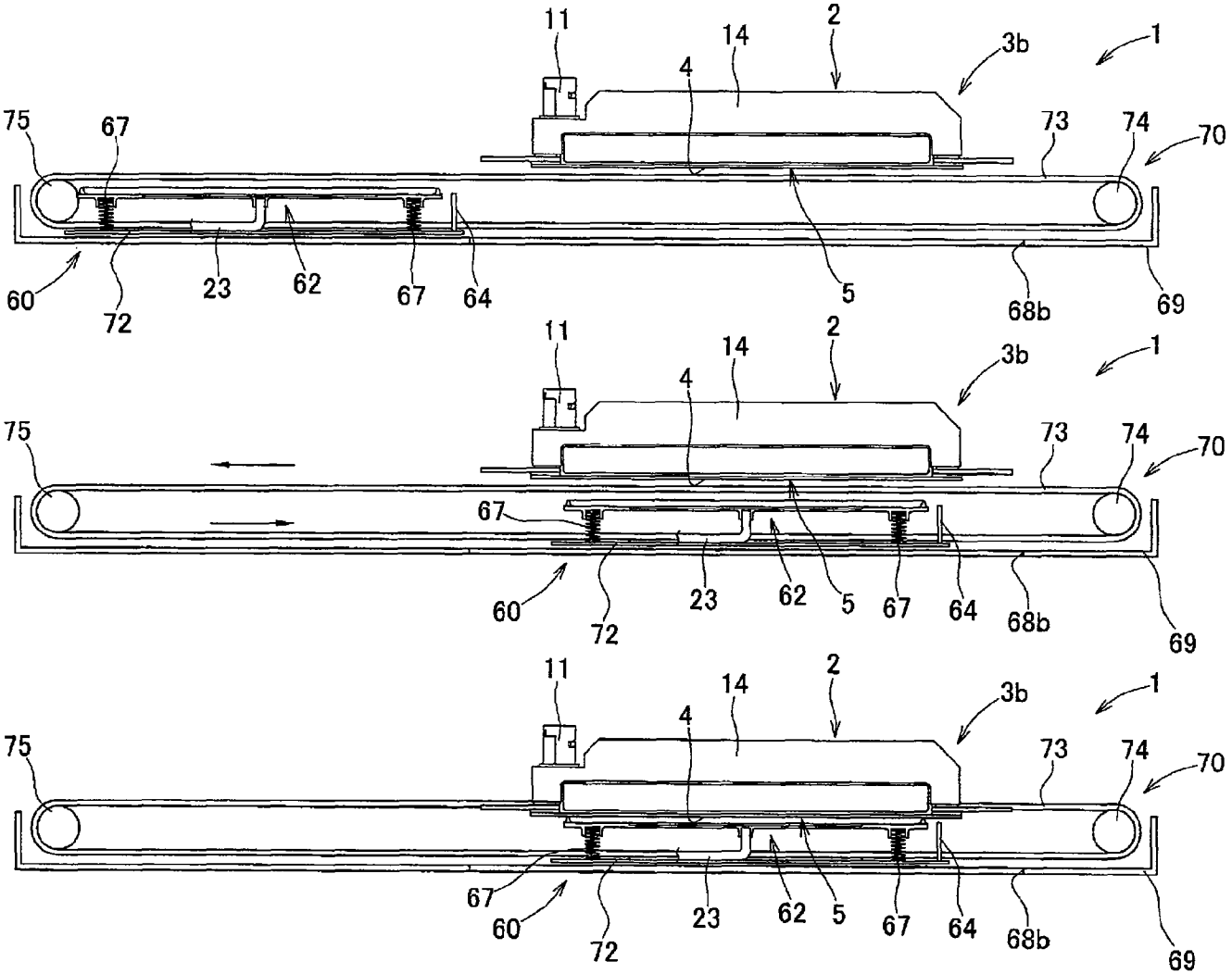
FIGS. 6A, 6B, and 6C time-sequentially show a capping operation for covering the ejection face of a head with a cap.

Next, a capping operation will be described with reference to FIGS. 6A to 6C. Before starting the capping operation, all heads 2 are moved up in advance from their printing positions to their maintenance positions, as shown in FIG. 6A. The roller 74 is then rotated counterclockwise in FIG. 6B to makes the belt 73 run. By the running of the belt 73, the supporting plates 71 and 72 are moved from their withdrawal positions to their capping positions.

When the supporting plates 71 and 72 have reached their capping positions, as shown in FIG. 6C, all heads 2 are moved down to their printing positions. Thereby, the ejection face 4 of each head 2 and the corresponding one of the caps 61 and 62 makes an enclosed space to prevent ink in the nozzles 4*a* of the head 2 from drying.

As described above, in this embodiment, the heads 2 are arranged so that their ejection faces 4 make two rows each extending in the sub scanning direction, and ejection faces 4 belonging to the different rows do not overlap each other with respect to the main scanning direction. Thus, an empty space is provided in a region neighboring each group of heads 2 with respect to the main scanning direction. The caps 61 or 62 corresponding to the heads 2 of each group are disposed within the space. Therefore, there is no necessity of providing any special space for providing the caps 61 or 62. This realizes a reduction in the size of the printer 1.

In addition, because the cartridges 91 are disposed under the caps, the empty spaces under the caps can effectively be used. This more effectively realizes a reduction in the size of the printer 1. Further, the difference in level between each head 2 and the corresponding cartridges 91 makes a difference in the heads of ink. Thus, a negative pressure in accordance with the difference in the ink heads is always applied to the ink in the head 2. This makes a stable ink meniscus in each nozzle 4*a*. As a result, the ink is prevented from leaking out.

The cartridges 91 are disposed under the caps 61 and 62 so as to sandwich the conveyance mechanism 10. This realizes a further reduction in the size of the printer 1.

The accessing faces to the cartridges 91 and the paper feed cassette 81 are provided in common at the front face of the printer 1. This facilitates the works of attachment, detachment, and exchange of each of the cartridges 91 and the paper feed cassette 81, and contributes a reduction in the size of the printer 1. In addition, because the paper feed cassette 81 is disposed under the conveyance mechanism 10 so as to be sandwiched by the cartridges 91 with respect to the main scanning direction, the size of the printer 1 can be more reduced.

Further, of the four cartridges 91, the inner two cartridges 91 are disposed so as to vertically overlap the heads 2. This realizes a further reduction in the size of the printer 1.

Because waste ink can be discarded simultaneously with exchange of the corresponding cartridge 91, there is no necessity of providing a separate large waste ink reservoir in the printer 1. This more effectively realizes a reduction in the size of the printer 1.

Because the moving mechanism 60 moves the caps 61 and 62 in the main scanning direction and the opposite direction, more effective use of space is realized.

By running of one belt 73, all caps 61 and 62 can be moved from their withdrawal positions to their capping positions, and from their capping positions to their withdrawal positions. This realizes a simple construction of the moving mechanism 70.

Each of the supporting plates 71 and 72 carries thereon four caps 61 or 62 and four wipers 63 or 64 so as to correspond to each of the head groups 3*a* and 3*b*. This makes it easy to dispose the belt 73.

The heads 2 belonging to the respective head groups 3*a* and 3*b* for ejecting black ink, which is the lowest in brightness, are closest to each other with respect to the sub scanning direction. Therefore, for example, even when a white A4-size paper is conveyed in a state that its long sides are oblique to the conveyance direction A, deviations of impact points of black ink ejected from those heads 2 are hard to be conspicuous. If the heads of the respective head groups for ejecting black ink are farthest from each other with respect to the sub scanning direction, this increases the difference in the timing of impact to the paper between black ink ejected from one head and black ink ejected from the other head. As a result, deviations of impact points of black ink become easy to be conspicuous. Contrastingly in this embodiment, because two heads 2 for ejecting black ink are closest to each other, the difference in the timings of impact to the paper is decreased. This decreases the deviations of impact points to be hard to be conspicuous.

The heads 2 belonging to the respective head groups 3*a* and 3*b* for ejecting yellow ink, which is the highest in brightness, are farthest from each other with respect to the sub scanning direction. Yellow ink is hard to be conspicuous. Thus, even when some deviations occur in impact points of yellow ink due to oblique conveyance of a paper, such deviations of impact points are hard to be conspicuous as a whole.

In a modification of using black papers, the above-described heads 2 for originally ejecting black ink may eject white ink. That is, the heads 2 closest to each other with respect to the sub scanning direction may eject ink of the most conspicuous color on the paper of inks ejected from all heads 2. Also in this modification, the heads 2 for ejecting ink of the most conspicuous color on the black paper, that is, white ink, are closest to each other with respect to the sub scanning direction. Therefore, even when the paper is conveyed obliquely to the conveyance direction A, deviations of impact points of white ink are hard to be conspicuous, like the above-described embodiment. In addition, the above-described heads 2 for originally ejecting yellow ink may eject gray ink. That is, the heads 2 farthest from each other with respect to the sub scanning direction may eject ink of the least conspicuous color on the paper of inks ejected from all heads 2. Also in this case, the heads 2 for ejecting ink of the least conspicuous color on the black paper, that is, gray ink, are farthest from each other with respect to the sub scanning direction. Therefore, even when the paper is conveyed obliquely to the conveyance direction A, deviations of impact points of gray ink are harder to be conspicuous, like the above-described embodiment.

Next, an inkjet printer 201 according to a second embodiment of the present invention will be described with reference to FIG. 7.

The inkjet printer 201 of this embodiment differs from the inkjet printer 1 of the first embodiment in the arrangement of heads 202. Accordingly, the arrangements of caps 261 and 262 and wipers 263 and 264 on a maintenance unit 260, and the construction of a moving mechanism 270 differ from those of the first embodiment. The other construction is the same as that of the first embodiment. For example, the construction in itself of each of the heads 202, the caps 261 and 262, and the wipers 263 and 264 is the same as that of the first embodiment, and only the arrangements of them differ from those of the first embodiment. In this embodiment, the same components as in the first embodiment are denoted by the same reference numerals as in the first embodiment, respectively, and the description thereof will be omitted.

Figure 7:
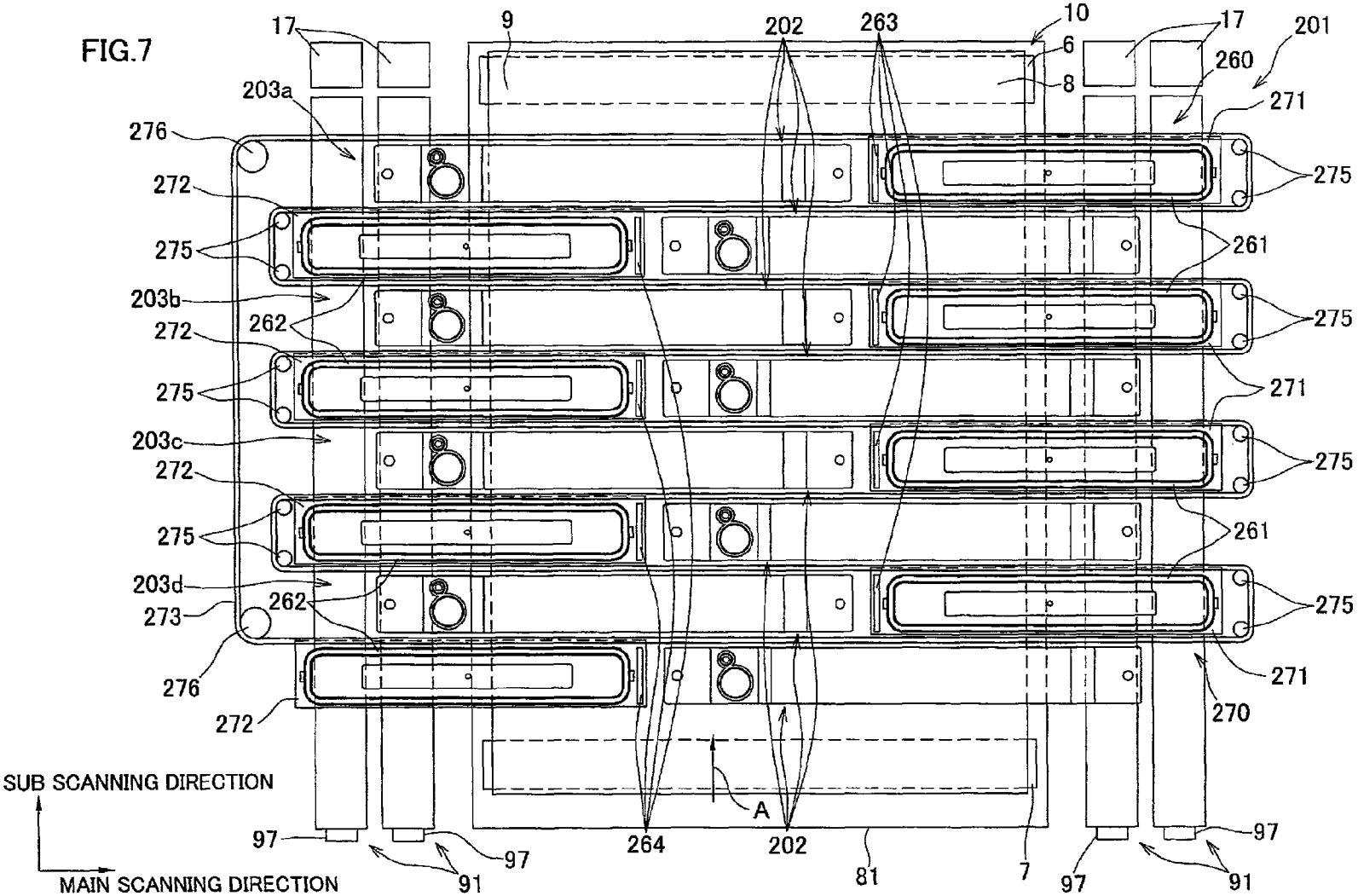
FIG. 7 is a plan view of a principal part of an inkjet printer according to a second embodiment of the present invention.

As shown in FIG. 7, the heads 202 make four head groups 203*a*, 203*b*, 203*c*, and 203*d*, each of which is constituted by two heads 202. The two heads 202 belonging to each head group neighbor each other with respect to the sub scanning direction, and they are distant from each other with respect to the main scanning direction. The four head groups 203*a* to 203*d* are arranged in parallel in the sub scanning direction. Eight heads 202 in total are arranged zigzag in the sub scanning direction to make two rows each of which is constituted by four heads 202. Neighboring two heads 202 in one row are disposed on both sides of one head 202 in the other row.

The two heads 202 belonging to each of the head groups 203*a* to 203*d* are disposed so that end portions of their ejection faces 4 partially overlap each other in the main scanning direction but their ejection regions 4*b* do not overlap each other to be continuous in the main scanning direction. The nozzles 4*a* of each two heads 202 neighboring each other with respect to the main scanning direction are in the same positional relation with respect to the main scanning direction as those of the first embodiment. All nozzles 4*a* of the two heads 202 belonging to each head group are arranged in the main scanning direction at regular intervals, which correspond to printing resolution.

The four head groups 203*a* to 203*d* eject inks of different colors. The two heads 202 belonging to one of the head groups 203*a* to 203*d* eject inks of the same color. A cartridge 91 storing therein magenta ink is connected to the two heads 202 belonging to the head group 203*a*; a cartridge 91 storing therein yellow ink is connected to the two heads 202 belonging to the head group 203*b*; a cartridge 91 storing therein cyan ink is connected to the two heads 202 belonging to the head group 203*c*; and a cartridge 91 storing therein black ink is connected to the two heads 202 belonging to the head group 203*d*. The arrangement and so on of the cartridges 91 are the same as those of the first embodiment.

A maintenance unit 260 includes eight caps 261 and 262 and eight wipers 263 and 264 respectively corresponding to the eight heads 202; and a moving mechanism 270 for moving the caps 261 and 262 and the wipers 263 and 264 in the main scanning direction and the opposite direction.

The moving mechanism 270 includes fourteen rollers 275; two rollers 276 somewhat larger in diameter than the rollers 275; a belt 273 wrapped on and stretched between the sixteen rollers 275 and 276; and eight supporting plates 271 and 272 each carrying thereon a cap and a wiper in one set.

Four supporting plates 271 are arranged in the sub scanning direction in a right portion in FIG. 7 so as to respectively correspond to the four heads 202 disposed leftward in FIG. 7. Four supporting plates 272 are arranged in the sub scanning direction in a left portion in FIG. 7 so as to respectively correspond to the four heads 202 disposed rightward in FIG. 7.

Each supporting plate 271 or 272 are disposed so as to be at the same position as the corresponding head 2 with respect to the sub scanning direction, and to neighbor the head 2 with respect to the main scanning direction. With respect to the main scanning direction, the supporting plates 271 and 272 overlap the heads 202 in the right and left rows in FIG. 7, respectively.

With respect to the sub scanning direction, each of the supporting plates 271 and 272 other than the outermost ones is sandwiched by two heads 202. That is, with respect to the sub scanning direction, the eight supporting plates 271 and 272 are arranged in a zigzag shape reverse to the zigzag shape of the arrangement of the eight heads 202. This realizes a reduction in the size of the printer 201.

Each pair of rollers 275 are disposed adjacent to each other at two corners of the outer ends, with respect to the main scanning direction, of seven supporting plates 271 and 272 other than the lowermost supporting plate 272 in FIG. 7.

The belt 273 is disposed on a loop path. More specifically, the belt 273 extends from the lower roller 276 in FIG. 7 rightward in the main scanning direction in FIG. 7; turns at two rollers 275; extends sequentially between each pair of heads 202 neighboring each other with respect to the sub scanning direction; and then reaches the upper right two rollers 275 in FIG. 7. The belt 273 further extends from that two rollers 275 leftward in a direction the reverse of the main scanning direction in FIG. 7; extends downward from the upper left roller 276 in FIG. 7; and then returns to the roller 276. The parts of the belt 273 extending in the main scanning direction and the opposite direction are parallel to each other, and disposed between each pair of neighboring heads 202. The supporting plates 271 and 272 are connected at their upper ends in FIG. 7 with the belt 273.

When the upper left roller 276 in FIG. 7 is driven by a not-shown drive motor to rotate counterclockwise in FIG. 7, the belt 273 runs. By the running of the belt 273, the supporting plates 271 and 272 are moved from their withdrawal positions to their capping positions so as to get near to each other. When the upper left roller 276 in FIG. 7 is driven by the not-shown drive motor to rotate clockwise in FIG. 7, the belt 273 runs in the reverse direction. By the running of the belt 273, the supporting plates 271 and 272 are moved from their capping positions to their withdrawal positions so as to get away from each other. In this construction, the maintenance unit 260 can perform maintenance for the heads 202 like the first embodiment.

As described above, in this second embodiment, the caps 261 and 262 corresponding to the respective heads 202 are disposed in the empty spaces neighboring the respective heads 2 with respect to the sub scanning direction. This brings about the same effect as that of the first embodiment in which the size of the printer 201 can be reduced.

In addition, even though the head groups 203*a* to 203*d* eject inks of different colors, the two heads 202 belonging to each of the head groups 203*a* to 203*d* eject inks of the same color. Therefore, for example, even when a white A4-size paper is conveyed in a state that its long sides are oblique to the conveyance direction A, deviations of impact points of inks ejected from the heads are hard to be conspicuous.

Next, an inkjet printer 301 according to a third embodiment of the present invention will be described with reference to FIG. 8. In the below-described third to seventh embodiments, the paper feed cassette 81, the cartridges 91, the pumps 17, the rollers 6 and 7, and so on, will be arbitrarily omitted.

The inkjet printer 201 of this embodiment has the same construction as the inkjet printer 1 of the first embodiment other than a moving mechanism 370 of a maintenance unit 360. Thus, in this embodiment, the same components as in the first embodiment are denoted by the same reference numerals as in the first embodiment, respectively, and the description thereof will be omitted.

The moving mechanism 370 includes two supporting plates 71 and 72; an endless belt 373 disposed along the outer ends of the supporting plates 71 and 72 with respect to the sub scanning direction; and four belt rollers 374, 375, 376, and 377 on which the belt 373 is wrapped. The belt rollers 374 to 377 are rotatably supported on a tray 69 so that the belt 373 surrounds all heads 2 and the supporting plates 71 and 72 in a plan view.

Figure 8:
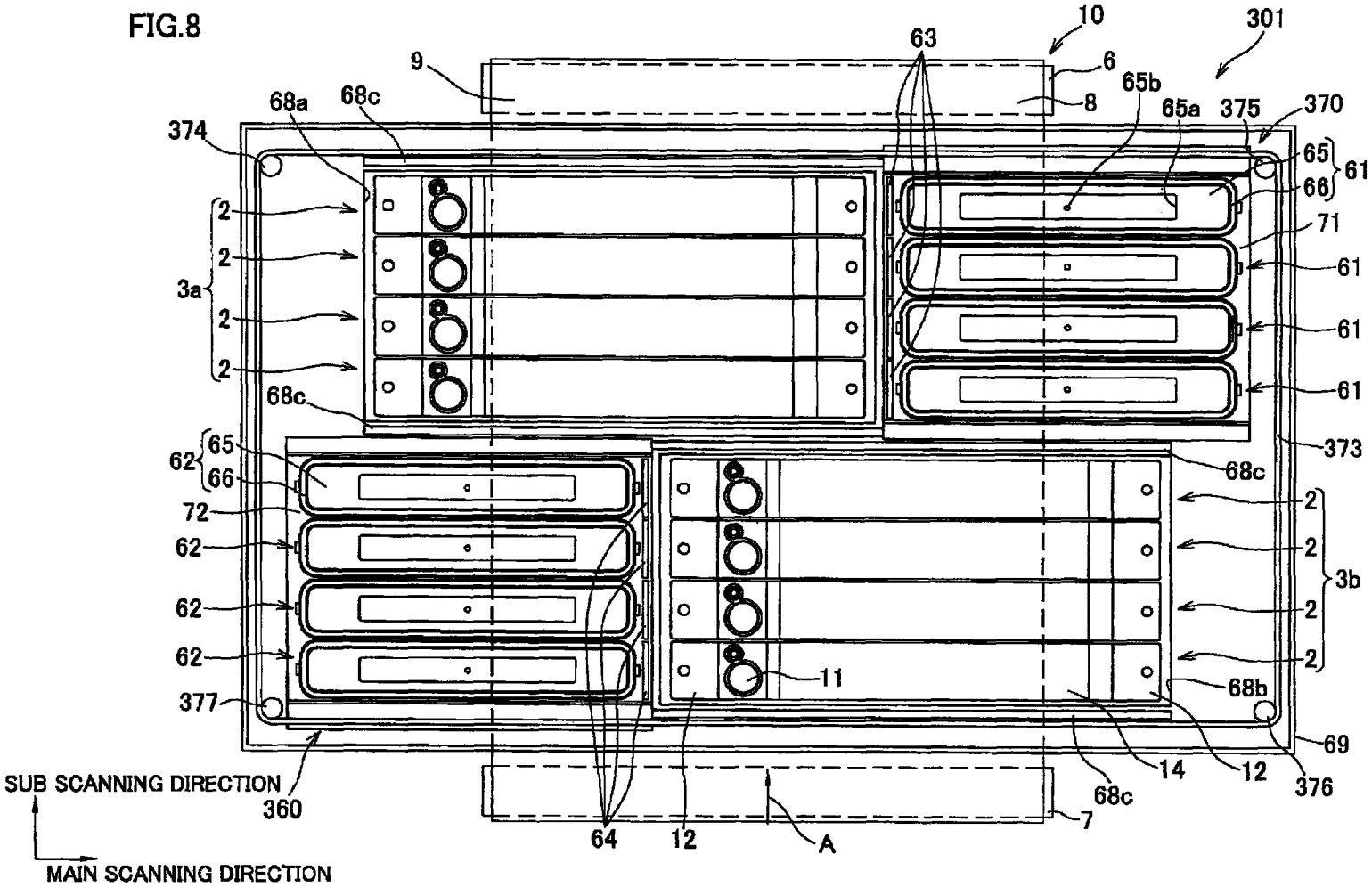
FIG. 8 is a plan view of a principal part of an inkjet printer according to a third embodiment of the present invention.

When the roller 374 is driven by a not-shown drive motor to rotate counterclockwise in FIG. 8, the supporting plates 71 and 72 are moved leftward and rightward in FIG. 8 from their withdrawal positions shown in FIG. 8 to their capping positions, respectively. When the roller 374 is rotated clockwise in FIG. 8, the supporting plates 71 and 72 are moved rightward and leftward in FIG. 8 from their capping positions to their withdrawal positions, respectively.

In the above-described construction, the maintenance unit 360 can perform maintenance for the heads 2 like the first embodiment.

According to this embodiment, because the belt 73 is disposed so as to surround all heads 2 and all caps 61 and 62 in a plan view, the interval between the head groups 3*a* and 3*b* can be reduced.

Next, an inkjet printer 401 according to a fourth embodiment of the present invention will be described with reference to FIG. 9.

In the inkjet printer 401 of this embodiment, like the second embodiment shown in FIG. 7, heads 402 make four head groups 403*a*, 403*b*, 403*c*, and 403*d*, each of which is constituted by two heads 402. However, the arrangement of the heads 402 differs from that of the second embodiment. Accordingly, the arrangements of caps 461 and 462 and wipers 463 and 464 on a maintenance unit 460, and the construction of a moving mechanism 470 differ from those of the second embodiment. The other construction is the same as that of the second embodiment. Thus, in this embodiment, the same components as in the second embodiment are denoted by the same reference numerals as in the second embodiment, respectively, and the description thereof will be omitted.

The two heads 402 belonging to each head group neighbor each other with respect to the sub scanning direction, and they are distant from each other with respect to the main scanning direction. The four head groups 403*a* to 403*d* are arranged in parallel in the sub scanning direction. Eight heads 402 in total are arranged zigzag in the sub scanning direction to make two rows each of which is constituted by four heads 402. In each pair of neighboring head groups, the head of one group closer to the other head group and the head of the other head group closer to the one head group with respect to the sub scanning direction are at the same position with respect to the main scanning direction. More specifically, for example, in FIG. 9, the left one of the two heads 402 belonging to the head group 403*a* and the left one of the two heads 402 belonging to the head group 403*b* are disposed at the same position with respect to the main scanning direction so as to neighbor each other with respect to the sub scanning direction.

This makes it possible to dispose the caps 461 and 462 and the wipers 463 and 464 at the same positions as the respectively corresponding heads 402 with respect to the sub scanning direction so as to neighbor respectively corresponding heads 402 with respect to the main scanning direction.

Like the second embodiment, the two heads 402 belonging to each of the head groups 403*a* to 403*d* are disposed so that end portions of their ejection faces 4 partially overlap each other in the main scanning direction but their ejection regions 4*b* do not overlap each other to be continuous in the main scanning direction. Like the second embodiment, the four head groups 403*a* to 403*d* eject inks of different colors.

A maintenance unit 460 includes eight caps 461 and 462 and eight wipers 463 and 464 respectively corresponding to the eight heads 402; and a moving mechanism 470 for moving the caps 461 and 462 and the wipers 463 and 464 in the main scanning direction and the opposite direction.

The moving mechanism 470 includes four shafts 481, 482, 483, and 484 extending in the sub scanning direction and supported by the printer main body so as to be rotatable around their axes; ten rollers 485, 486, 487, 488, 489, 490, 491, 492, 493, and 494 provided on the shafts 481 to 484; five belts 495, 496, 497, 498, and 499 wrapped on the rollers 485 to 494 to be stretched in the main scanning direction; and five supporting plates 471, 472, 473, 474, and 475 connected with the respective belts 495 to 499.

Figure 9:
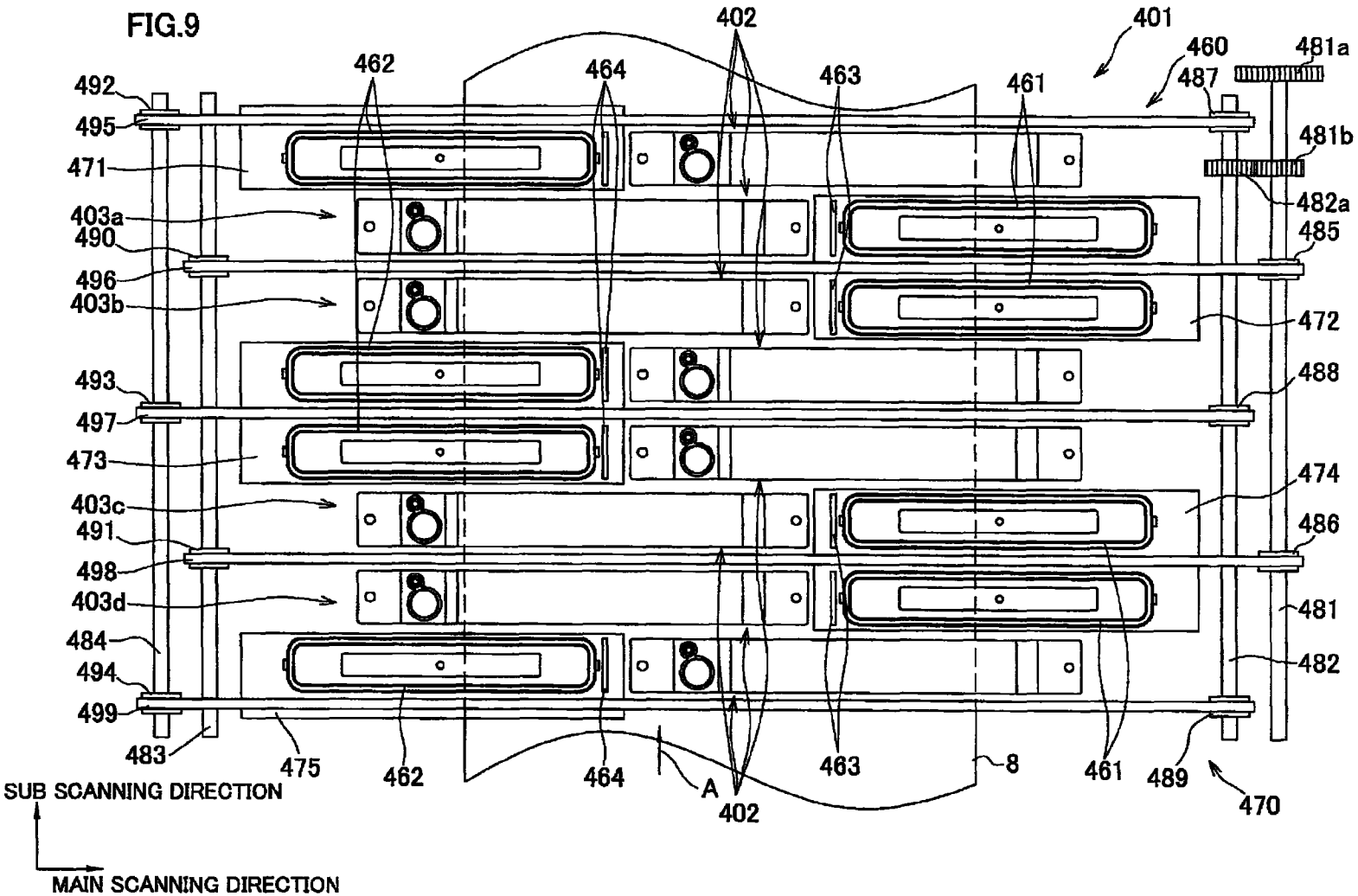
FIG. 9 is a plan view of a principal part of an inkjet printer according to a fourth embodiment of the present invention.

A gear 481*a* is fixed to the upper end of the shaft 481 in FIG. 9 so as to be rotatable with the shaft 481 around the axis of the shaft 481. Two gears 481*b* and 482*a* are fixed to the respective shafts 481 and 482 near ends of the shafts 481 and 482 so as to be rotatable with the respective shafts 481 and 482 around the respective axes of the shafts 481 and 482. The gears 481*b* and 482*a* engage with each other. Thus, when the gear 481*a* is driven by a not-shown drive motor to rotate in a predetermined direction, the shaft 481 rotates in the same direction, and the shaft 482 is rotated in the opposite direction from the rotation of the shaft 481 through the gears 481*b* and 482*a*.

Of the ten rollers 485 to 494, two rollers 485 and 486 are fixed to the shaft 481 so as to be rotatable with the shaft 481 around the axis of the shaft 481; and three rollers 487 to 489 are fixed to the shaft 482 so as to be rotatable with the shaft 482 around the axis of the shaft 482. Of the remaining five rollers 490 to 494, two rollers 490 and 491 are rotatably supported on the shaft 483 at the same positions as the respective rollers 485 and 486 with respect to the sub scanning direction; and three rollers 492 to 494 are rotatably supported on the shaft 484 at the same positions as the respective rollers 487 to 489 with respect to the sub scanning direction.

The belt 495 is wrapped on and stretched between the rollers 487 and 492 so as to be disposed outside the head group 403*a* with respect to the sub scanning direction. The belt 496 is wrapped on and stretched between the rollers 485 and 496 so as to be disposed in between the head groups 403*a* and 403*b*. The belt 497 is wrapped on and stretched between the rollers 488 and 497 so as to be disposed in between the head groups 403*b* and 403*c*. The belt 498 is wrapped on and stretched between the rollers 486 and 498 so as to be disposed in between the head groups 403*c* and 403*d*. The belt 499 is wrapped on and stretched between the rollers 489 and 494 so as to be disposed outside the head group 403*d* with respect to the sub scanning direction.

In FIG. 9, the upper left supporting plate 471 is disposed at the same position as the other head 402 of the head group 403*a*, that is, the right head 402, with respect to the sub scanning direction so as to overlap the one head 402 of the head group 403*a*, that is, the left head 402, with respect to the main scanning direction. The supporting plate 471 carries thereon a cap 462 and a wiper 464 corresponding to the other head 402, and it is connected with a part of the belt 495 extending in the main scanning direction.

In FIG. 9, the lower left supporting plate 475 is disposed at the same position as the other head 402 of the head group 403*d* with respect to the sub scanning direction so as to overlap the one head 402 of the head group 403*d* with respect to the main scanning direction. The supporting plate 475 carries thereon a cap 462 and a wiper 464 corresponding to the other head 402, and it is connected with a part of the belt 499 extending in the main scanning direction.

The supporting plate 472 is disposed at the same position as the one heads 402 of the head groups 403*a* and 403*b* with respect to the sub scanning direction so as to overlap the other heads 402 of the head groups 403*a* and 403*b* with respect to the main scanning direction. The supporting plate 473 is disposed at the same position as the other heads 402 of the head groups 403*b* and 403*c* with respect to the sub scanning direction so as to overlap the one heads 402 of the head groups 403*b* and 403*c* with respect to the main scanning direction. The supporting plate 474 is disposed at the same position as the one heads 402 of the head groups 403*c* and 403*d* with respect to the sub scanning direction so as to overlap the other heads 402 of the head groups 403*c* and 403*d* with respect to the main scanning direction.

Each of the supporting plates 472 to 474 carries thereon two caps and two wipers corresponding to two heads 402 sandwiched by outer two heads 402 of neighboring two head groups with respect to the sub scanning direction. More specifically, the supporting plate 472 carries thereon two caps 461 and two wipers 463 corresponding to the one heads 402 of the head groups 403*a* and 403*b*, and it is connected with a part of the belt 496 extending in the main scanning direction. The supporting plate 473 carries thereon two caps 462 and two wipers 464 corresponding to the other heads 402 of the head groups 403*b* and 403*c*, and it is connected with a part of the belt 497 extending in the main scanning direction. The supporting plate 474 carries thereon two caps 461 and two wipers 463 corresponding to the one heads 402 of the head groups 403*c* and 403*d*, and it is connected with a part of the belt 498 extending in the main scanning direction.

As described above, each of the three supporting plates 472 to 474 carries thereon two caps 461 or 462 and two wipers 463 or 464 corresponding to two heads 402. This simplifies the construction of the moving mechanism 470.

Any of the belts 495 to 499 is disposed so that its parts extending in the main scanning direction are vertically opposed to each other. Thus, as shown in FIG. 9, even though each of the belts 496 to 498 is disposed in between head groups, the interval between the head groups can be narrow.

The supporting plates 471 to 475 are connected with the lower parts of the respective belts 495 to 499.

When the gear 481*a* is driven by a not-shown drive motor to rotate in a predetermined direction, the supporting plates 472 and 474 and the supporting plates 471, 473, and 475 are respectively moved leftward and rightward in FIG. 9, that is, in a direction opposite to the main scanning direction and in the main scanning direction, from their withdrawal positions shown in FIG. 9 to their capping positions. Thereby, all caps 461 and 462 and all wipers 463 and 464 on the supporting plates 471 to 475 are put at positions opposed to the ejection faces 4 of the respectively corresponding heads 402.

When the gear 481*a* is rotated in a direction the reverse of the predetermined direction, the supporting plates 472 and 474 and the supporting plates 471, 473, and 475 are respectively moved rightward and leftward in FIG. 9, that is, in the main scanning direction and in a direction opposite to the main scanning direction, from their capping positions to their withdrawal positions shown in FIG. 9. Thereby, all caps 461 and 462 and all wipers 463 and 464 on the supporting plates 471 to 475 are put at positions not opposed to the ejection faces 4 of the respectively corresponding heads 402.

The caps 461 or 462 and the wipers 463 or 464 respectively corresponding to the two heads 402 belonging to each of the head groups 403*a* to 403*d* are moved in directions opposite to each other with respect to the main scanning direction. In this construction, the maintenance unit 460 can perform maintenance for the heads 402 like the first embodiment.

Next, an inkjet printer 501 according to a fifth embodiment of the present invention will be described with reference to FIG. 10.

In the inkjet printer 501 of this embodiment, the arrangement of heads 502 somewhat differs from that of the fourth embodiment. Accordingly, the arrangements of caps 561 and 562 and wipers 563 and 564 on a maintenance unit 560, and the construction of a moving mechanism 570 differ from those of the fourth embodiment. The other construction is the same as that of the fourth embodiment. Thus, in this embodiment, the same components as in the fourth embodiment are denoted by the same reference numerals as in the fourth embodiment, respectively, and the description thereof will be omitted.

Figure 10:
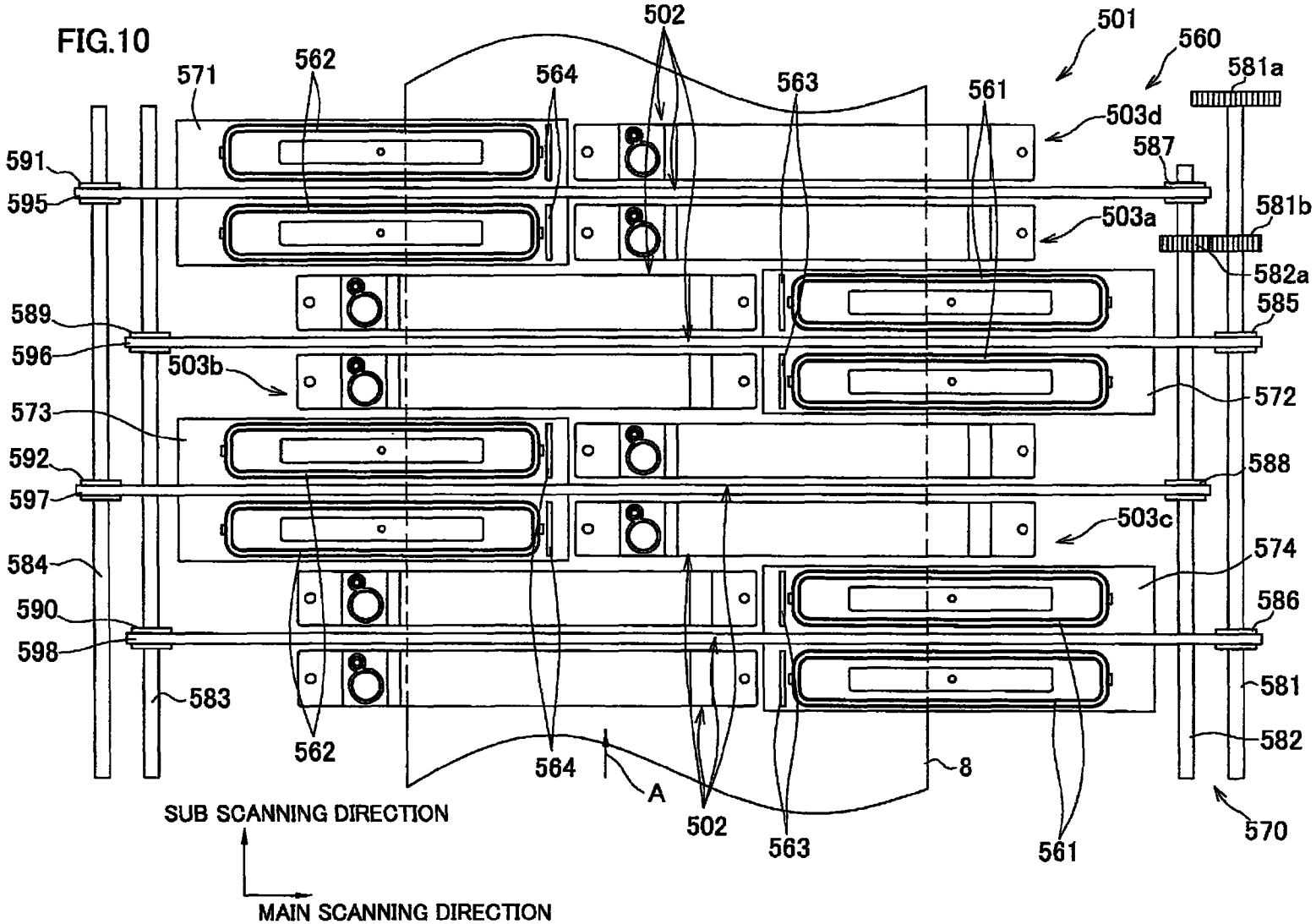
FIG. 10 is a plan view of a principal part of an inkjet printer according to a fifth embodiment of the present invention.

As shown in FIG. 10, heads 502 are arranged so that their ejection faces 4 make two rows extending in the sub scanning direction, each of which is constituted by four ejection faces 4, and ejection faces 4 belonging to the different rows do not overlap each other with respect to the main scanning direction. The heads 502 make three head groups 503*a*, 503*b*, and 503*c* each of which is constituted by two heads 502 whose ejection faces 4 neighbor each other with respect to the sub scanning direction and belong to the different rows; and a head group 503*d* that is constituted by two heads 502 between which the three head groups 503*a*, 503*b*, and 503*c* are sandwiched with respect to the sub scanning direction.

The three head groups 503*a*, 503*b*, and 503*c* are arranged in parallel with respect to the sub scanning direction so that one head 502 belonging to the head group 503*a*, that is, the left head 502 in FIG. 10, and one head 502 belonging to the head group 503*b* are disposed at the same position with respect to the main scanning direction so as to neighbor each other with respect to the sub scanning direction; and the other head 502 belonging to the head group 503*b*, that is, the right head 502 in FIG. 10, and the other head 502 belonging to the head group 503*c* are disposed at the same position with respect to the main scanning direction so as to neighbor each other with respect to the sub scanning direction.

In the above-described arrangement, the caps 561 or 562 and the wipers 563 or 564 corresponding to neighboring two heads 502 belonging to neighboring ones of the head groups 503*a*, 503*b*, and 503*d* can be disposed at the same position with respect to the main scanning direction so as to neighbor each other with respect to the sub scanning direction.

Of all heads 502 belonging to the head groups 503*a*, 503*b*, and 503*c*, the outermost two heads 502 with respect to the sub scanning direction are disposed at the same positions with respect to the main scanning direction as the two heads 502 belonging to the head group 502*d* and neighboring those heads 502, respectively. In this arrangement, the caps 562 and the wipers 564 corresponding to the other head 502 of the head group 503*d*, that is, the right head 502 in FIG. 10, and the head 502 of the head group 503*a* neighboring the other head 502 of the head group 503*d* can be disposed at the same position with respect to the main scanning direction so as to neighbor each other with respect to the sub scanning direction. The same applies to the caps 561 and the wipers 563 corresponding to the one head 502 of the head group 503*d* and the head 502 of the head group 503*c* neighboring the one head 502 of the head group 503*d*.

Like the fourth embodiment, the two heads 502 belonging to each of the head groups 503*a* to 503*d* are disposed so that end portions of their ejection faces 4 partially overlap each other in the main scanning direction but their ejection regions 4*b* do not overlap each other to be continuous in the main scanning direction. Like the second and fourth embodiments, the four head groups 503*a* to 503*d* eject inks of different colors. More specifically, the head groups 503*a*, 503*b*, and 503*c* eject black ink, magenta ink, and cyan ink, respectively, and the head group 503*d* ejects yellow ink, which is the highest in brightness.

In this embodiment, yellow ink, which is the highest in brightness, is ejected from the head group 503*d* constituted by the two heads 502 farthest from each other with respect to the sub scanning direction. Therefore, for example, even when a white A4-size paper is conveyed in a state that its long sides are oblique to the conveyance direction A, deviations of impact points of inks ejected from the heads 502 are hard to be conspicuous.

In a modification of using black papers, the above-described heads 502 for originally ejecting yellow ink may eject gray ink. That is, the heads 502 of the head group 503*d* farthest from each other with respect to the sub scanning direction may eject ink of the least conspicuous color on the paper of inks ejected from all heads 502. In this modification, the heads 502 for ejecting ink of the least conspicuous color on the black paper, that is, gray ink, are farthest from each other with respect to the sub scanning direction. Therefore, even when the paper is conveyed obliquely to the conveyance direction A, deviations of impact points of gray ink are harder to be conspicuous, like the above-described embodiment.

A maintenance unit 560 includes eight caps 561 and 562 and eight wipers 563 and 564 respectively corresponding to the eight heads 502; and a moving mechanism 570 for moving the caps 561 and 562 and the wipers 563 and 564 in the main scanning direction and the opposite direction.

The moving mechanism 570 includes four shafts 581 to 584 extending in the sub scanning direction and supported by the printer main body so as to be rotatable around their axes; eight rollers 585 to 592 provided on the shafts 581 to 584; four belts 595 to 598 wrapped on the rollers 585 to 592 to be stretched in the main scanning direction; and four supporting plates 571 to 574 connected with the respective belts 595 to 598.

A gear 581*a* is fixed to the upper end of the shaft 581 in FIG. 10 so as to be rotatable with the shaft 581 around the axis of the shaft 581. Two gears 581*b* and 582*a* are fixed to the respective shafts 581 and 582 near ends of the shafts 581 and 582 so as to be rotatable with the respective shafts 581 and 582 around the respective axes of the shafts 581 and 582. The gears 581*b* and 582*a* engage with each other. Thus, when the gear 581*a* is driven by a not-shown drive motor to rotate in a predetermined direction, the shaft 581 rotates in the same direction, and the shaft 582 is rotated in the opposite direction from the rotation of the shaft 581 through the gears 581*b* and 582*a*.

Of the eight rollers 585 to 592, two rollers 585 and 586 are fixed to the shaft 581 so as to be rotatable with the shaft 581 around the axis of the shaft 581; and two rollers 587 and 588 are fixed to the shaft 582 so as to be rotatable with the shaft 582 around the axis of the shaft 582. Of the remaining four rollers 589 to 592, two rollers 589 and 590 are rotatably supported on the shaft 583 at the same positions as the respective rollers 585 and 586 with respect to the sub scanning direction; and two rollers 591 and 592 are rotatably supported on the shaft 584 at the same positions as the respective rollers 587 and 588 with respect to the sub scanning direction.

The belt 595 is wrapped on and stretched between the rollers 587 and 591 so as to be disposed in between the other head 502 of the head group 503*d* and the head group 503*a*. The belt 596 is wrapped on and stretched between the rollers 585 and 589 so as to be disposed in between the head groups 503*a* and 503*b*. The belt 597 is wrapped on and stretched between the rollers 588 and 592 so as to be disposed in between the head groups 503*b* and 503*c*. The belt 598 is wrapped on and stretched between the rollers 586 and 590 so as to be disposed in between the one head 502 of the head group 503*d* and the head group 503*c*.

The supporting plate 571 is disposed at the same position as the other heads 502 of the head groups 503*a* and 503*d*, that is, the right heads 502 in FIG. 10, with respect to the sub scanning direction so as to overlap the one heads 502 of the head groups 503*a* and 503*d*, that is, the left heads 502 in FIG. 10, with respect to the main scanning direction. The supporting plate 571 carries thereon two caps 562 and two wipers 564 corresponding to the other heads 502, and it is connected with a part of the belt 591 extending in the main scanning direction.

The supporting plate 572 is disposed at the same position as the one heads 502 of the head groups 503*a* and 503*b* with respect to the sub scanning direction so as to overlap the other heads 502 of the head groups 503*a* and 503*b* with respect to the main scanning direction. The supporting plate 572 carries thereon two caps 561 and two wipers 563 corresponding to the other heads 502, and it is connected with a part of the belt 596 extending in the main scanning direction.

The supporting plate 573 is disposed at the same position as the other heads 502 of the head groups 503*b* and 503*c* with respect to the sub scanning direction so as to overlap the one heads 502 of the head groups 503*b* and 503*c* with respect to the main scanning direction. The supporting plate 573 carries thereon two caps 562 and two wipers 564 corresponding to the other heads 502, and it is connected with a part of the belt 597 extending in the main scanning direction.

The supporting plate 574 is disposed at the same position as the one heads 502 of the head groups 503*c* and 503*d* with respect to the sub scanning direction so as to overlap the other heads 502 of the head groups 503*c* and 503*d* with respect to the main scanning direction. The supporting plate 574 carries thereon two caps 561 and two wipers 563 corresponding to the other heads 502, and it is connected with a part of the belt 598 extending in the main scanning direction.

As described above, each of the four supporting plates 571 to 574 carries thereon two caps 561 or 562 and two wipers 563 or 564 corresponding to two heads 502. This simplifies the construction of the moving mechanism 570.

Any of the belts 595 to 598 is disposed so that its parts extending in the main scanning direction are vertically opposed to each other. Thus, as shown in FIG. 10, even though each of the belts 595 to 598 is disposed in between the other head 502 of the head group 503*d* and the head group 503*a*, in between three head groups 503*a*, 503*b*, and 503*c*, or in between the one head 502 of the head group 503*d* and the head group 503*c*, the interval between them can be narrow.

The supporting plates 571 to 574 are connected with the lower parts of the respective belts 595 to 598.

When the gear 581*a* is driven by a not-shown drive motor to rotate in a predetermined direction, the supporting plates 572 and 574 and the supporting plates 571 and 573 are respectively moved leftward and rightward in FIG. 10, that is, in a direction opposite to the main scanning direction and in the main scanning direction, from their withdrawal positions shown in FIG. 10 to their capping positions. Thereby, all caps 561 and 562 and all wipers 563 and 564 on the supporting plates 571 to 574 are put at positions opposed to the ejection faces 4 of the respectively corresponding heads 502.

When the gear 581*a* is rotated in a direction the reverse of the predetermined direction, the supporting plates 572 and 574 and the supporting plates 571 and 573 are respectively moved rightward and leftward in FIG. 10, that is, in the main scanning direction and in a direction opposite to the main scanning direction, from their capping positions to their withdrawal positions shown in FIG. 10. Thereby, all caps 561 and 562 and all wipers 563 and 564 on the supporting plates 571 to 574 are put at positions not opposed to the ejection faces 4 of the respectively corresponding heads 502.

The caps 561 or 562 and the wipers 563 or 564 respectively corresponding to the two heads 502 belonging to each of the head groups 503*a* to 503*d* can be moved in directions opposite to each other with respect to the main scanning direction. In this construction, the maintenance unit 560 of this embodiment can perform maintenance for the heads 502 like the first embodiment.

Next, an inkjet printer 601 according to a sixth embodiment of the present invention will be described with reference to FIG. 11.

The inkjet printer 601 of this embodiment has the same construction as the inkjet printer 401 of the fourth embodiment other than a moving mechanism 670 of a maintenance unit 660. Thus, in this embodiment, the same components as in the fourth embodiment are denoted by the same reference numerals as in the fourth embodiment, respectively, and the description thereof will be omitted.

The moving mechanism 670 includes eleven rollers 677; a belt 676 wrapped on and stretched between the rollers 677; and five supporting plates 471 to 475 connected with respective parts of the belt 676 extending in the main scanning direction. The rollers 677 are disposed so that the parts of the belt 676 extending in the main scanning direction are disposed parallel to each other with respect to the sub scanning direction in between and outside four head groups 403*a* to 403*d*.

In this embodiment, the number of parts of the belt 676 extending in the main scanning direction in between neighboring heads 402 is smaller than that of the second embodiment. This simplifies the construction of the moving mechanism 670.

Figure 11:
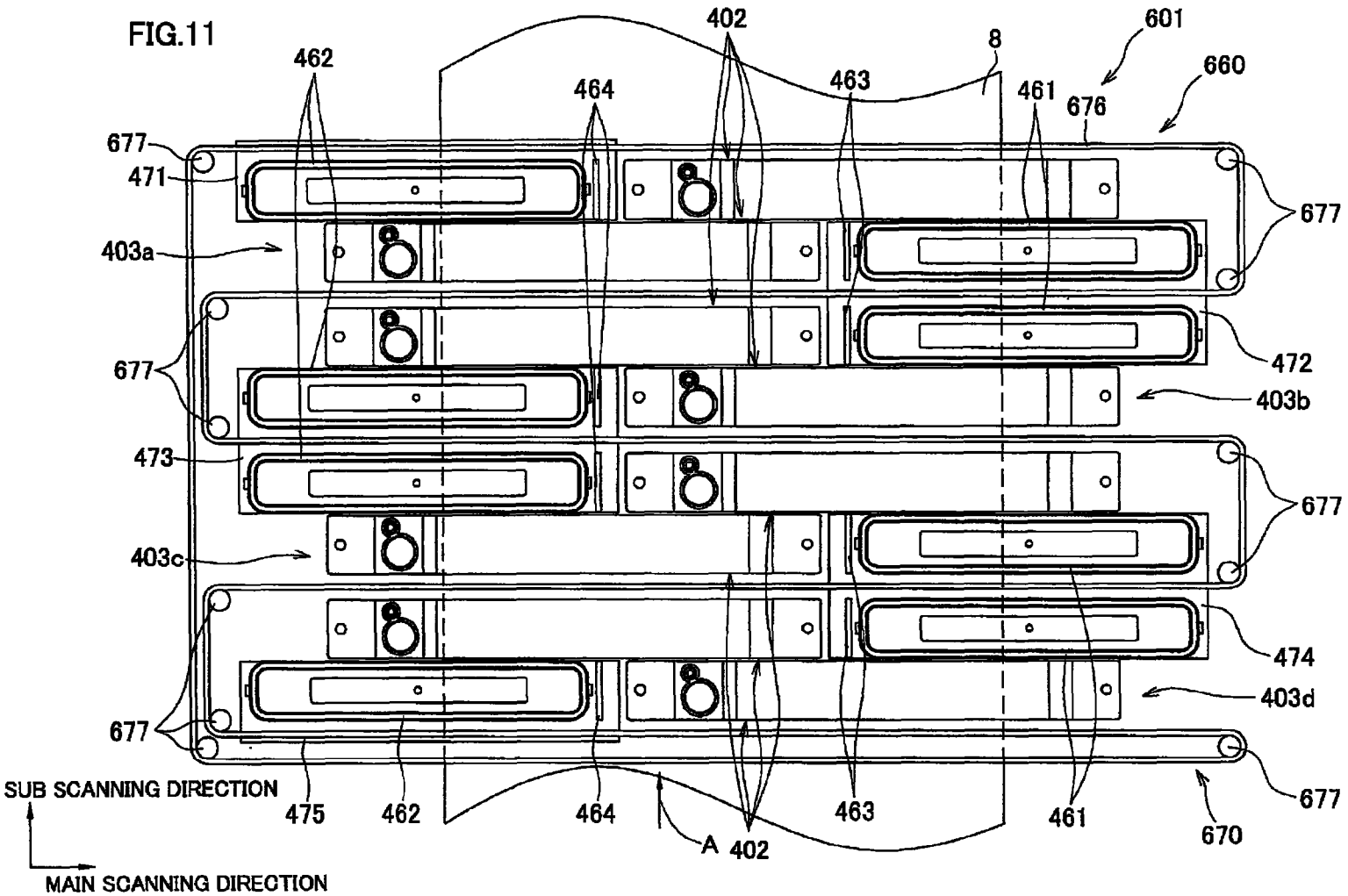
FIG. 11 is a plan view of a principal part of an inkjet printer according to a sixth embodiment of the present invention.

When the upper left roller 677 in FIG. 11 is driven by a not-shown drive motor to rotate clockwise in FIG. 11, the supporting plates 472 and 474 and the supporting plates 471, 473, and 475 are respectively moved leftward and rightward in FIG. 11, that is, in a direction opposite to the main scanning direction and in the main scanning direction, from their withdrawal positions shown in FIG. 11 to their capping positions. Thereby, all caps 461 and 462 and all wipers 463 and 464 on the supporting plates 471 to 475 are put at positions opposed to the ejection faces 4 of the respectively corresponding heads 402.

When the upper left roller 677 in FIG. 11 is driven by the not-shown drive motor to rotate counterclockwise in FIG. 11, the supporting plates 472 and 474 and the supporting plates 471, 473, and 475 are respectively moved rightward and leftward in FIG. 11, that is, in the main scanning direction and in a direction opposite to the main scanning direction, from their capping positions to their withdrawal positions shown in FIG. 11. Thereby, all caps 461 and 462 and all wipers 463 and 464 on the supporting plates 471 to 475 are put at positions not opposed to the ejection faces 4 of the respectively corresponding heads 402.

In the above-described construction, the maintenance unit 660 can perform maintenance for the heads 402 like the first embodiment.

Next, an inkjet printer 701 according to a seventh embodiment of the present invention will be described with reference to FIG. 12.

The inkjet printer 701 of this embodiment has the same construction as the inkjet printer 501 of the fifth embodiment other than a moving mechanism 770 of a maintenance unit 760. Thus, in this embodiment, the same components as in the fifth embodiment are denoted by the same reference numerals as in the fifth embodiment, respectively, and the description thereof will be omitted.

The moving mechanism 770 includes eight rollers 777; a belt 776 wrapped on and stretched between the rollers 777; and four supporting plates 571 to 574 connected with respective parts of the belt 776 extending in the main scanning direction. The rollers 777 are disposed so that the parts of the belt 776 extending in the main scanning direction are disposed parallel to each other with respect to the sub scanning direction in between three head groups 503*a*, 503*b*, and 503*d*, in between the other head 502 of the head group 503*d* and the head group 503*a*, and in between the one head 502 of the head group 503*d* and the head group 503*c*.

In this embodiment, the number of parts of the belt 776 extending in the main scanning direction in between neighboring heads 502 is smaller than that of the second embodiment. This simplifies the construction of the moving mechanism 770.

Figure 12:
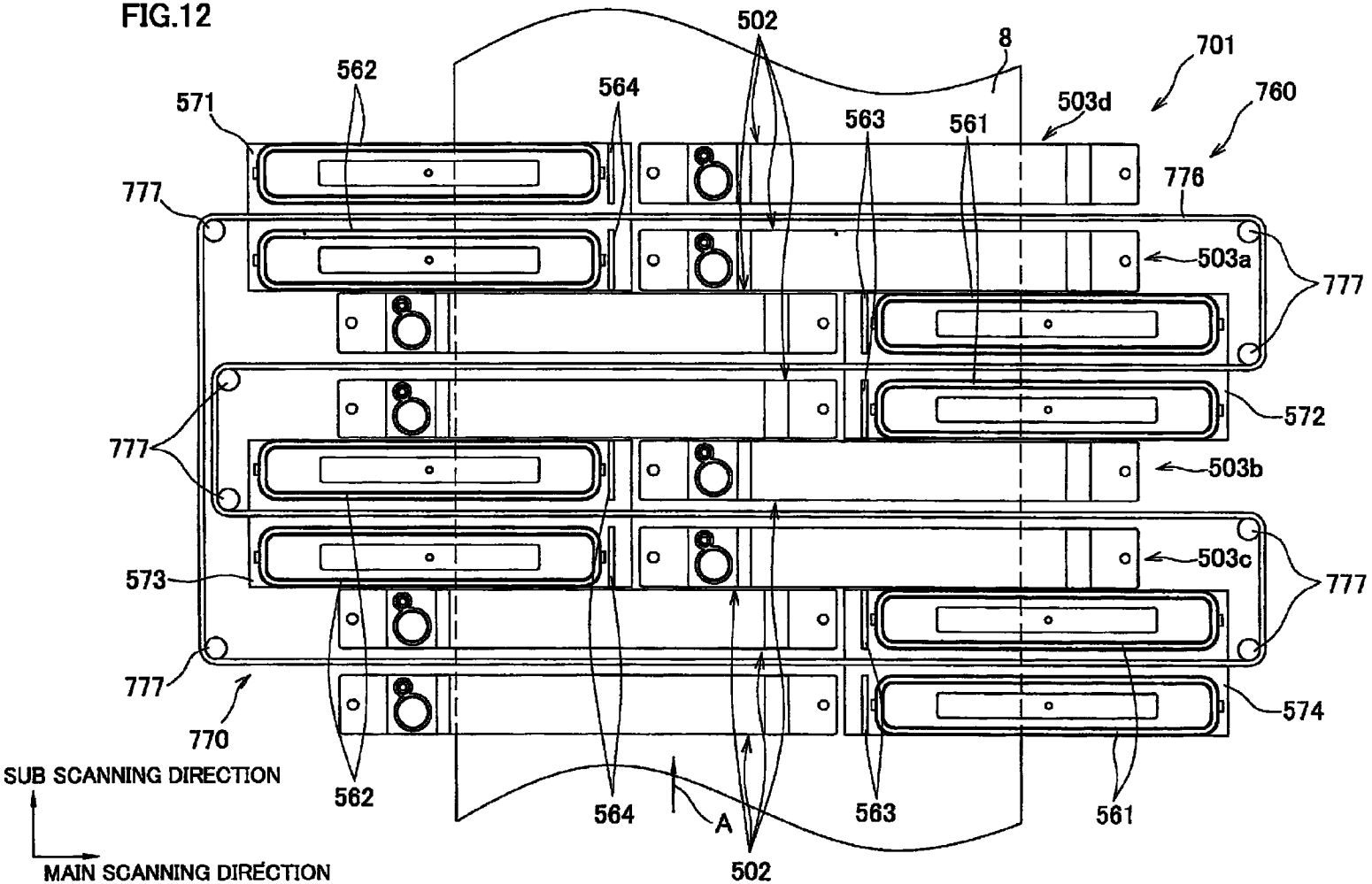
FIG. 12 is a plan view of a principal part of an inkjet printer according to a seventh embodiment of the present invention.

When the upper left roller 777 in FIG. 12 is driven by a not-shown drive motor to rotate clockwise in FIG. 12, the supporting plates 572 and 574 and the supporting plates 571 and 573 are respectively moved leftward and rightward in FIG. 12, that is, in a direction opposite to the main scanning direction and in the main scanning direction, from their withdrawal positions shown in FIG. 12 to their capping positions. Thereby, all caps 561 and 562 and all wipers 563 and 564 on the supporting plates 571 to 574 are put at positions opposed to the ejection faces 4 of the respectively corresponding heads 502.

When the upper left roller 777 in FIG. 12 is driven by the not-shown drive motor to rotate counterclockwise in FIG. 12, the supporting plates 572 and 574 and the supporting plates 571 and 573 are respectively moved rightward and leftward in FIG. 12, that is, in the main scanning direction and in a direction opposite to the main scanning direction, from their capping positions to their withdrawal positions shown in FIG. 12. Thereby, all caps 561 and 562 and all wipers 563 and 564 on the supporting plates 571 to 574 are put at positions not opposed to the ejection faces 4 of the respectively corresponding heads 502.

In the above-described construction, the maintenance unit 760 can perform maintenance for the heads 502 like the first embodiment.

In a modification, the belt 73 may not be a flat rubber belt having a very narrow width. It may be a rubber belt circular in section. Or, it may be a metal wire. In fact, any member that can serve as a belt can be used as the belt 73.

The number of springs 67 for supporting the caps 61 or 62 is not limited to two. One spring or three or more springs may be used for that purpose. In another modification, no spring 67 may be used.

In the above-described embodiments, a purge operation is performed in a state that the caps 61 and 62 are not in contact with the ejection faces 4 of the respectively corresponding heads. In a modification, however, a purge operation may be performed in a state that the caps 61 and 62 are in contact with the ejection faces 4 of the respectively corresponding heads. This modification can surely prevent ejected inks from scattering around the caps 61 and 62.

In a modification of the second embodiment, each roller 276 may have the same diameter as each roller 275.

In the above-described embodiments, two heads for ejecting inks of the same color are arranged so that continuous printing can be performed with respect to the main scanning direction when the two heads eject inks to form an image. In a modification, however, such two heads may be arranged so that they do not overlap each other with respect to the sub scanning direction, and discontinuous printing is performed with respect to the main scanning direction when the heads eject inks to form an image.

In the above-described embodiments, four cartridges 91 are disposed under the caps that are at their withdrawal positions. In a modification, however, only one cartridge 91 may be disposed under the caps. In another modification, the cartridges 91 may be disposed with respect to the main scanning direction so as to sandwich only one of the conveyance mechanism 10 and the paper feed cassette 81. In still another modification, the cartridges 91 may be disposed with respect to the main scanning direction so as to neighbor the conveyance mechanism 10 and the paper feed cassette 81 without sandwiching them. In still another modification, the cartridges 91 may be disposed so that one of them is disposed on one side of the conveyance mechanism 10 and the paper feed cassette 81 and three of them are disposed on the other side. In still another modification, the same number of cartridges 91 as the heads may be disposed. In the above-described embodiments, each cartridge 91 stores therein ink of one color. In a modification, however, one cartridge 91 may store therein inks of different colors. In this modification, the number of cartridges 91 can be more reduced.

In the above-described second and fourth to seventh embodiments, the two heads constituting each head group eject inks of the same color. In a modification, however, they may eject inks of different colors.

In a modification, no wiper may be used.

In a modification, a moving mechanism may include a plurality of supporting members for carrying thereon wipers and caps independently of each other; and a mechanism for moving the wipers and the caps separately or together.

In a modification, a moving mechanism may move caps parallel to the ejection faces of the heads in directions other than the main scanning direction and a direction opposite to the main scanning direction between their capping positions where the caps are opposed to the ejection faces of the respectively corresponding heads, and their withdrawal positions where the caps are not opposed to the ejection faces of the respectively corresponding heads.

In a modification in which each paper is scarcely conveyed in an oblique state, two heads for ejecting inks of the same color, relatively farther from each other with respect to the sub scanning direction, may eject black inks, or two heads for ejecting inks of the same color, adjacent to each other with respect to the sub scanning direction, may eject yellow inks.

An image recording apparatus of the present invention is never limited to such an inkjet printer. The present invention can be applied to apparatuses for ejecting a conductive paste onto a substrate to form fine wiring patterns; for ejecting organic luminous liquids onto a substrate to make a high-definition display; and for ejecting an optical resin onto a substrate to make a minute electronic device such as an optical waveguide. Further, the present invention can be applied to various kinds of apparatuses other than printers, such as copying machines and facsimiles.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus comprising:

a plurality of heads each of which has an ejection face, the heads being arranged so that their ejection faces make a first array and a second array each of which extends in a first direction and comprises a plurality of ejection faces of respective heads, and ejection faces belonging to the different arrays do not overlap each other with respect to a second direction parallel to the ejection faces and perpendicular to the first direction;

a conveyance mechanism configured to convey a recording medium in the first direction in a state that the recording medium is facing the ejection faces;

a plurality of caps configured to contact with the respective ejection faces to cover the ejection faces; and a moving mechanism configured to move the caps, along the second direction, between capping positions where the caps are opposed to the respective ejection faces with respect to a third direction perpendicular to the ejection faces, and withdrawal positions where the caps are not opposed to the respective ejection faces with respect to the third direction, when the caps are at their withdrawal positions, the caps corresponding to the respective heads constituting the first array being disposed so as to overlap the heads of the first array with respect to the second direction, and overlap the heads of the second array with respect to the first direction, and the caps corresponding to the respective heads constituting the second array being disposed so as to overlap the heads of the second array with respect to the second direction, and overlap the heads of the first array with respect to the first direction, wherein the moving mechanism is configured to move the caps corresponding to the respective heads constituting the first array from their withdrawal positions to their capping positions in the second direction and the moving mechanism is configured to move the caps corresponds to the respective heads constituting the second array from their withdrawal positions to their capping positions in a direction opposite of the second direction.

2. The apparatus according to claim 1, wherein the moving mechanism comprises a plurality of rollers; and a belt that is wrapped on and stretched between the plurality of rollers, and connected with all caps so as to move the caps from their withdrawal positions to their capping positions when the belt runs.

3. The apparatus according to claim 1, wherein two head groups make the respective first and second arrays, and each of the head groups is constituted by at least two heads arranged so that their ejection faces are disposed at the same position with respect to the second direction, and neighbor each other with respect to the first direction.

4. The apparatus according to claim 3, wherein the moving mechanism comprises:

a plurality of rollers;

a belt that is wrapped on and stretched between the plurality of rollers, and connected with all caps so as to move the caps from their withdrawal positions to their capping positions when the belt runs;

a first supporting member that is connected with the belt and carries thereon a plurality of caps corresponding to the respective heads belonging to one head group at the same positions as the heads with respect to the first direction; and a second supporting member that is connected with the belt and carries thereon a plurality of caps corresponding to the respective heads belonging to the other head group at the same positions as the heads with respect to the first direction.

5. The apparatus according to claim 4, wherein the belt is disposed so as to surround all heads and all caps in a plan view.

6. The apparatus according to claim 3, wherein the heads of the head group making the first array and the heads of the head group making the second array eject liquids of the same colors, respectively, the heads of each head group eject liquids of different colors, and ones of all heads that eject liquids of the most conspicuous color on the recording medium are closest to each other with respect to the first direction.

7. The apparatus according to claim 6, wherein the most conspicuous color is a color the lowest in brightness of the colors of the liquids to be ejected from all heads.

8. The apparatus according to claim 6, wherein ones of all heads that eject liquids of the least conspicuous color on the recording medium are farthest from each other with respect to the first direction.

9. The apparatus according to claim 8, wherein the least conspicuous color is a color the highest in brightness of the colors of the liquids to be ejected from all heads.

10. The apparatus according to claim 1, wherein a plurality of head groups make the first and second arrays, and each head group is constituted by two heads whose ejection faces neighbor each other with respect to the first direction to make the respective first and second arrays.

11. The apparatus according to claim 10, wherein the heads of different head groups eject liquids of different colors.

12. The apparatus according to claim 10, wherein the head groups are arranged in parallel with respect to the first direction so that the heads are arranged zigzag with respect to the first direction.

13. The apparatus according to claim 12, wherein the moving mechanism comprises a plurality of supporting members that are connected with the belt and carry thereon the caps, and parts of the belt extending in the second direction are disposed with respect to the first direction on one outer side of the head groups and in between the heads of the head groups.

14. The apparatus according to claim 10, wherein the head groups are arranged in parallel so that the one side head of the two heads of one head group and the one side head of the two heads of another head group neighboring the one head group are disposed at the same position with respect to the second direction so as to neighbor each other with respect to the first direction, and the other side head of the two heads of the other head group and the other side head of the two heads of a head group on the opposite side of the other head group from the one head group are disposed at the same position with respect to the second direction so as to neighbor each other with respect to the first direction.

15. The apparatus according to claim 14, wherein the moving mechanism comprises:

a supporting member carrying thereon two caps respectively corresponding to two heads sandwiched by the outermost two heads of neighboring head groups with respect to the first direction, and a belt connected with the supporting member for moving the caps in the second direction from their withdrawal positions to their capping positions when the belt runs in the second direction.

16. The apparatus according to claim 15, wherein a part of the belt extending in the second direction is disposed in between the neighboring two head groups.

17. The apparatus according to claim 15, wherein the belt is disposed in between the neighboring two head groups, and parts of the belt extending in the second direction are opposed to each other with respect to the third direction.

18. The apparatus according to claim 1, wherein a plurality of first head groups and a second head group make the first and second arrays, each first head group is constituted by two heads whose ejection faces neighbor each other with respect to the first direction to make the respective first and second arrays, the second head group is constituted by two heads sandwiching the plurality of first head groups with respect to the first direction, and the first head groups are arranged in parallel in the first direction so that the one side head of the two heads of one first head group and the one side head of the two heads of another first head group neighboring the one first head group are disposed at the same position with respect to the second direction so as to neighbor each other with respect to the first direction, and the other side head of the two heads of the other first head group and the other side head of the two heads of a first head group on the opposite side of the other first head group from the one first head group are disposed at the same position with respect to the second direction so as to neighbor each other with respect to the first direction.

19. The apparatus according to claim 18, wherein the outermost one in the first direction of all heads of the first head groups and the head of the second head group neighboring the outermost head are disposed at the same position with respect to the second direction.

20. The apparatus according to claim 19, wherein the moving mechanism comprises:

a first supporting member carrying thereon two caps respectively corresponding to two heads sandwiched by the outermost two heads of neighboring two first head groups with respect to the first direction;

a second supporting member carrying thereon a cap corresponding to the one outermost head of all heads of the plurality of first head groups with respect to the first direction, and a cap corresponding to the head of the second head group neighboring the one outermost head;

a third supporting member carrying thereon a cap corresponding to the other outermost head of all heads of the plurality of first head groups with respect to the first direction, and a cap corresponding to the head of the second head group neighboring the other outermost head; and a plurality of belts connected with the respective first, second, and third supporting members for moving the caps from their withdrawal positions to their capping positions when the belts run in the second direction and/or in a direction opposite to the second direction.

21. The apparatus according to claim 20, wherein parts of the belts extending in the second direction are disposed in between the first head groups and outside the first head groups.

22. The apparatus according to claim 18, wherein the heads of different head groups eject liquids of different colors, and the heads of the second head group eject liquids of the least conspicuous color on the recording medium of the colors of the liquids to be ejected from all heads.

23. The apparatus according to claim 22, wherein the least conspicuous color is a color the highest in brightness of the colors of the liquids to be ejected from all heads.

24. The apparatus according to claim 1, wherein the apparatus further comprises a plurality of liquid cartridges each having therein a liquid reservoir that stores therein a liquid to be fed to a head, and at least one of the cartridges is disposed under the withdrawal positions of the caps so as not to overlap the conveyance mechanism with respect to the third direction.

25. The apparatus according to claim 24, wherein the cartridges are disposed on both sides of the conveyance mechanism with respect to the second direction under the caps when the caps are put at their withdrawal positions.

26. The apparatus according to claim 25, wherein the apparatus further comprises a cassette configured to store therein a plurality of recording media and is disposed under the conveyance mechanism so as to be attachable and detachable in the first direction and a direction opposite to the first direction, and the cartridges are disposed on both sides of the cassette with respect to the second direction so as to be attachable and detachable in the same directions as the cassette.

27. The apparatus according to claim 26, wherein at least one of the cartridges is disposed so as to overlap the heads with respect to the third direction.

28. The apparatus according to claim 24, wherein each cartridge has therein a waste liquid reservoir that configured to store therein a waste liquid ejected from a head in a purge operation.

29. The apparatus according to claim 1, wherein each of the caps corresponding to the respective heads constituting the first array and the caps corresponding to the respective heads constituting the second array are connected with at least one roller and are configured to move concurrently in the opposite directions parallel to the second direction when the at least one roller rotates.

30. The apparatus according to claim 1, wherein the moving mechanism is configured to move the caps corresponding to the respective heads constituting the first array and the caps corresponds to the respective heads constituting the second array simultaneously from their withdrawal positions to their capping positions.

31. The apparatus according to claim 30, wherein the moving mechanism is configured to begin moving the caps corresponding to the respective heads constituting the first array and the caps corresponds to the respective heads constituting the second array from their respective withdrawal positions simultaneously and stop moving the caps corresponding to the respective heads constituting the first array and the caps corresponds to the respective heads constituting the second array at their respective capping positions simultaneously.

32. The apparatus according to claim 1, wherein entire ejection faces belonging to the different arrays do not overlap each other with respect to a second direction parallel to the ejection faces and perpendicular to the first direction.

33. The apparatus according to claim 1, wherein the caps corresponding to the respective heads constituting the first array are separated from the caps corresponding to the respective heads constituting the second array.

34. An image recording apparatus comprising:

a first head and a second head downstream from the first head in a first direction, wherein each of the first and second heads has an ejection face, and the second head is disposed upstream from the first head in a second direction parallel to the ejection faces and perpendicular to the first direction;

a first cap configured to contact and cover the ejection face of the first head and a second cap configured to contact and cover the ejection face of the second head; and a moving mechanism configured to move the first and second caps between capping positions where the first and the second caps are opposed to the respective ejection faces with respect to a third direction perpendicular to the ejection faces, and withdrawal positions where the caps are not opposed to the respective ejection faces with respect to the third direction, when the first and second caps are at their withdrawal positions:

a downstream end of the first cap in the second direction is downstream from an upstream end of the second head in the second direction and upstream from an upstream end of the first head in the second direction, and an upstream end of the second cap in the second direction is downstream from a downstream end of the second head in the second direction and upstream from a downstream end of the first head in the second direction, wherein the moving mechanism is configured to move the first cap from its withdrawal position to its capping position in the second direction, and move the second cap from its withdrawal position to its capping position in a direction opposite of the second direction.

* * * * *